US009230526B1

(12) United States Patent
Cook et al.

(10) Patent No.: US 9,230,526 B1
(45) Date of Patent: Jan. 5, 2016

(54) COMPUTER KEYBOARD INSTRUMENT AND IMPROVED SYSTEM FOR LEARNING MUSIC

(71) Applicant: Infinite Music, LLC, Gainesville, FL (US)

(72) Inventors: Darin R. Cook, Gainesville, FL (US); Jason D. Cook, Gainesville, FL (US)

(73) Assignee: Infinite Music, LLC, Gainesville, FL (US)

( * ) Notice: Subject to any disclaimer, the term of this patent is extended or adjusted under 35 U.S.C. 154(b) by 248 days.

(21) Appl. No.: 13/933,114

(22) Filed: Jul. 1, 2013

(51) Int. Cl.
*G10H 7/00* (2006.01)
*G10H 1/00* (2006.01)

(52) U.S. Cl.
CPC ..... *G10H 1/0033* (2013.01)

(58) Field of Classification Search
CPC ... A01B 12/006; A01B 12/008; G10H 1/0033
USPC ..... 84/636
See application file for complete search history.

(56) References Cited

U.S. PATENT DOCUMENTS

| | | | | |
|---|---|---|---|---|
| 5,886,273 | A * | 3/1999 | Haruyama | 84/478 |
| 8,975,500 | B2 * | 3/2015 | Iriyama | 84/600 |
| 2001/0029829 | A1 * | 10/2001 | Moe | 84/478 |
| 2002/0007719 | A1 * | 1/2002 | Hasegawa | 84/609 |
| 2003/0177892 | A1 * | 9/2003 | Akazawa et al. | 84/616 |
| 2004/0177745 | A1 * | 9/2004 | Kayama | 84/609 |
| 2004/0206225 | A1 * | 10/2004 | Wedel | 84/477 R |
| 2005/0150362 | A1 * | 7/2005 | Uehara | 84/645 |
| 2005/0241462 | A1 * | 11/2005 | Hirano | 84/600 |
| 2007/0163428 | A1 * | 7/2007 | Salter | 84/611 |
| 2007/0175317 | A1 * | 8/2007 | Salter | 84/609 |
| 2007/0245881 | A1 * | 10/2007 | Egozy et al. | 84/609 |
| 2007/0256540 | A1 * | 11/2007 | Salter | 84/485 R |
| 2008/0210083 | A1 * | 9/2008 | Nakayama et al. | 84/636 |
| 2009/0308230 | A1 * | 12/2009 | Kayama | 84/622 |
| 2011/0011244 | A1 * | 1/2011 | Homburg | 84/612 |
| 2011/0011246 | A1 * | 1/2011 | Buskies et al. | 84/613 |
| 2012/0312145 | A1 * | 12/2012 | Kellett et al. | 84/613 |
| 2013/0031220 | A1 * | 1/2013 | Moncavage et al. | 709/219 |

* cited by examiner

*Primary Examiner* — Jeffrey Donels
(74) *Attorney, Agent, or Firm* — Todd Partners, P.C.; Jack D. Todd

(57) ABSTRACT

A computerized system for enabling a user to compose a song comprises displaying a compose song screen to the user on a video display, the compose song screen including a play bar associated with the current time position of the song; enabling the user to create a first track of the song, wherein the track is associated with an instrument selected by the user, wherein notes of the instrument are assigned to respective keys on a computer keyboard, and wherein the user chooses a tempo for the song, wherein, upon initiating of recording of the track, keys pressed by the user on the keyboard (i) are translated into visual notes on the screen that move, at the tempo, across the play bar and (ii) generate audio output that corresponds to notes from the selected instrument. Multiple tracks, for different instruments, can be created and combined to create a multi-track song.

35 Claims, 21 Drawing Sheets

COMPUTER KEYBOARD INSTRUMENT AND IMPROVED SYSTEM FOR LEARNING MUSIC

FIELD OF THE PRESENT TECHNOLOGY

The present technology relates generally to software systems and software applications running on computing devices and, more particularly, to systems and methods for learning to play, playing, and composing music using a computer keyboard as an input for the instrument. The present system provides a user with a real time experience and game-type environment in which to play and compose music solo or in collaboration with others using a computer keyboard as the instrument input.

BACKGROUND OF THE PRESENT TECHNOLOGY

Traditionally, there has been a great divide between learning to play a real instrument and playing a toy instrument in conjunction with a simulated music computer or video game. Take, for example, a real guitar. A guitar is a stringed instrument that takes significant time and effort to learn to play. For example, an individual typically must take numerous lessons from a trained guitar player to learn properly how to hold the instrument, to play chords and notes, to tune the instrument, and to read music and play musical scores, and the like. Because of this difficulty and the need to learn from a trained musician, learning how to play a song of even moderate complexity requires some skill or natural ability and a significant time investment by the individual learning to play. These barriers not only can be demotivating, but require a high level of commitment and dedication (and, often, expense) trying to learn to play—with no guarantee that such effort and costs will be rewarded.

Today, there exists a disparity between (i) having fun playing a video game like "Guitar Hero®," "Rock Band®," "Jammit®," or the like with a toy instrument and (ii) actually playing a real instrument. To attempt to address this disparity, game makers have been making toy instruments for use with computer and video games more and more realistic and, hence, more complex and difficult to play, which defeats the purpose of playing a video game in the first place. In other words, it is becoming less fun for novices and casual gamers to try to play music video games as the "toy" instruments have become more realistic and require more actual skill with the instrument to be able to play the game well and to have fun. Thus, there exists a need to try to close the disparity between still having fun playing music video games while, at the same time, actually learning how to play real music without unnecessarily complicating the game instrument.

There is a need to be able to remove the upfront learning curve by using a computer keyboard or a virtual keyboard as the basis for playing notes and chords. Since most people today are familiar with where letters are on a computer keyboard, the upfront learning curve of learning to play music on a computer keyboard instrument is completely eliminated and songs of moderate difficulty can be played in the matter of hours.

There is also a need to be able to use a game style interface to learn how to play a computer keyboard instrument. A computer keyboard instrument allows a user to leverage their "built in" memory of typing to master relatively complex songs quickly. Such a system also enables a user to have fun playing a music video game as they receive feedback and learn what key to hit to play a specific note and how long to hold down such key to sustain the specific note.

There is a further need such that, once a user has obtained enough mastery of basic song patterns from playing the video game, such user can leverage that knowledge to use the system and computer keyboard instrument to compose original music, something typically reserved for accomplished musicians.

There is a need for a thriving, global user group and interactive community, in which songs can be played or created at the same time with friends, opponents, and bands within that user group and community.

By using the computer keyboard as the input for a new instrument type, such instrument would allow a user to play notes in an arcade-style setting while learning to play real music. There is a further need for a system in which, unlike with most conventional musical instruments, not only can the layout and method that notes are presented be dynamically and programmatically changed, but the scale that the computer keyboard is tuned for can be adjusted on a per song and per track basis. Such a system would ease the burden of learning to play songs that are performed in C major scale, in D scale, or any other scale.

Additionally, there is a need for a system in which the keyboard's octave range can be dynamically adjusted based off of the pitch range of a current music track being played by the system, which would make for a comfortable playing experience, regardless of the octave range within which the current instrument is performing.

There is a further need for a video or computer game experience (unlike the experience of "Guitar Hero®," "Rock Band®," "Jammit®," or the like) that plays exactly what notes the user hits, potentially with a minor enhancement of volume adjustment or the completing a chord, rather than merely playing the correct note regardless of what key is hit or pressed by the user. There is a need for a video game music experience that is not merely simulated, but more realistic by playing the notes corresponding to the keys actually pressed or hit by the user. Such a system would give the user actual feedback—making them feel completely connected to the experience rather than disconnected. This is possible because of the simplicity of learning to play notes using a computer keyboard.

There is also a need for a system and video game experience that enables a user to play the game with others as well as create music in real time with other users.

There is a further need for a system and video game experience that is able to provide virtual awards, items, special events, and customized profile pages. There is a further need for a system and video game experience that is able to interact with and interface with social media platforms, such as Facebook® and Twitter®, to allow the user to present their skills to friends and to engage in friendly competition and challenges. Such social engagement would enable a user to persevere through more challenging aspects of the video game experience without becoming worn out or abandoning the endeavor of learning music when more lengthy time is required. Such a scenario would be more likely to occur when learning to play songs of increasing complexity, as well as becoming an accomplished musician.

There is a further need for a system and video game experience that enables a user to compose music using the same game interface and experience through which a user learns how to play existing music or tracks. In addition, there is a need for a system that enables a user to create new music using modern computing capabilities, such as drag and drop, to easily transform an idea of play into a completely composed final rendition.

There is another need for a system and video game experience that enables a user to play a selected track, out of a plurality of available tracks, associated with a pre-recorded musical performance. Preferably, the system and video game experience would play all other tracks (e.g., vocals, specific instruments) other than the one track the user wants to play. Similarly, in a multi-user or "band" setting, each user can select a particular track to play and any unselected tracks would be played by the system.

The present technologies, as described and shown in greater detail hereinafter, address and teach one or more of the above-referenced capabilities, needs, and features that are useful for a variety of purposes and applications as described, taught, and suggested herein in greater detail.

SUMMARY OF THE PRESENT TECHNOLOGY

The present technology relates generally to software systems and software applications running on computing devices and, more particularly, to systems and methods for learning to play, playing, and composing music using a computer keyboard as an input for an instrument. The present system provides a user with a real time experience and game-type environment in which to play and compose music solo or in collaboration with others using a computer keyboard as the instrument input.

A first aspect of the technology disclosed herein includes computerized system for enabling a user to compose a song, comprising: a processor, a memory storage, a video display, a keyboard, an audio output, and a computer program product, wherein the video display, the keyboard, and the audio output are each in electronic communication with the processor, and wherein the computer program product includes a computer-readable medium that is usable by the processor and is operatively coupled to the memory storage, the computer-readable medium having stored thereon a sequence of instructions that when executed by the processor causes the execution of the steps of: (a) displaying a compose song screen to the user on the video display, the compose song screen having a progress bar displaying a timeline ranging between a start time and an end time of the song, the progress bar including a thumb that is scrollable along the timeline and that, based on its relative position along the timeline, identifies the current time position of the song between the start time and the end time, the compose song screen further having a play bar associated with the current time position of the song; (b) enabling the user to name a first track of the song and to select an instrument to be associated with said first track; (c) assigning notes of the selected instrument to respective keys on the keyboard; (d) enabling the user to select a tempo for the song, the tempo identifying a number of beats per minute and a number of beats per measure for the song, wherein each measure of the song is illustrated graphically on the compose song screen and positioned relative to the play bar; and (e) upon initiating recording of the first track: (i) causing each graphically-illustrated measure of the song to scroll sequentially toward and across the play bar at a speed determined by the tempo of the song; (ii) receiving notes from the user based on one or more keys pressed by the user on the keyboard, each of said notes being associated with the current time position of the song based on when the key associated with each respective note is pressed and having a duration based on how long the key associated with each respective note is held; and (iii) wherein, in response to each key pressed by the user: (A) a graphical representation of the note assigned to each respective key is generated and initially displayed within the measure currently scrolling across the play bar on the compose song screen and wherein the length of the graphical representation of the respective note corresponds to the duration of the respective note; and (B) an audio representation of the note assigned to each respective key is generated and played by the audio output for the duration, the sound of the note corresponding to the selected instrument.

In a feature, the computer-readable medium further causes the execution of the step of stopping the recording of the first track or enabling the user to stop the recording of the first track. In one embodiment, the stopping of the recording defines the end time of the song. In another embodiment, the stopping of the recording defines a time prior to the end time of the song.

In another feature, after stopping the recording of the first track, the computer-readable medium further causes the execution of the step of saving the recording of the first track or enabling the user to save the recording of the first track.

In yet another feature, after stopping the recording of the first track, the computer-readable medium further causes the execution of the step of replaying the recording of the first track or enabling the user to replay the recording of the first track.

In another feature, during recording of the first track, the computer-readable medium further causes the execution of the step of generating a beat that is played through the audio output and that corresponds to the tempo of the song.

In yet a further feature, the user is able to change the current time position of the song by moving the scrollable thumb to a desired position along the timeline.

In another feature, the graphical representation of the note assigned to each respective key includes a graphic symbol that corresponds with the respective key.

In yet another feature, the play bar is linear, has a predefined width, and is fixedly displayed near an edge of the compose song screen. In a preferred embodiment, the graphical representation of the note is fixedly displayed within the measure currently scrolling across the compose song screen such that the graphical representation of the note moves perpendicularly across the play bar.

Preferably, the video display, the keyboard, and the audio output are all components of a computing device of the user. In preferred embodiments, the user's computing device includes one of the following: a cell phone, a smart phone, a PDA, a desktop computer, a laptop computer, a multimedia device, or a computer tablet.

In one preferred embodiment, the row of keys on the keyboard represents a range of musical notes and wherein the pitch of each of the range of notes increases with each key moving in a linear direction along the row. In another preferred embodiment, a first row of keys on the keyboard represents a first octave of musical notes and a second row of keys on the keyboard represents a second octave of musical notes. In another preferred embodiment, a row of keys on the keyboard represent a range of musical notes and wherein pressing one of the shift keys on the keyboard changes the octave of the range of musical notes. In another preferred embodiment, each of a plurality of keys on the keyboard is associated with a unique musical note and wherein pressing a chord modifier key on the keyboard reassigns each of the respective plurality of keys to a chord associated with each corresponding musical note.

A second aspect of the technology disclosed herein includes an electronic music system, comprising: a processor, a memory storage, a video display, an input for interacting with a user, an audio output, and a computer program product, wherein the video display, the user input, and the audio output are each in electronic communication with the processor, and wherein the computer program product includes a computer-readable medium that is usable by the processor and is operatively coupled to the memory storage, the computer-readable medium having stored thereon a sequence of instructions that when executed by the processor causes the execution of the steps of: (a) generating one or more objects, each object associated with a respective musical note of a song, each object having a front and a tail defining therebetween a respective length, the respective length of the object indicative of the duration of the musical note associated with the object; (b) displaying the one or more objects on the video display, the one or more objects each having a graphic symbol included therein, each graphic symbol corresponding with a respective key on the user input, the respective key being associated with the musical note associated with the respective object, the one or more objects being initially displayed near one edge of the video display; (c) displaying a linear play bar on the video display, the play bar having a predefined width and being fixedly displayed near an opposite edge of the video display from the one or more objects; (d) upon initiation of playback of the song, moving the one or more objects from the one edge of the video display perpendicularly toward the play bar, wherein when the front of each respective object reaches the play bar indicates when the musical note associated with the respective object should be played and when the tail end of the respective object leaves the play bar indicates when the musical note associated with the respective object should cease being played; (e) receiving input from the user in the form of one or more keys being pressed and then released by the user as the one or more objects move perpendicularly toward and across the play bar; (f) in response to the input received from the user, generating sounds that are played through the audio output, each of the sounds corresponding with the musical note associated with the respective key pressed by the user and continuing until the respective key is released by the user; and (g) providing feedback to the user based on when each key is pressed and released by the user as compared to when each corresponding object crosses over the play bar.

In a feature, the video display, the user input, and the audio output are all components of a computing device of the user. Preferably, the user's computing device includes one of the following: a cell phone, a smart phone, a PDA, a desktop computer, a laptop computer, a multimedia device, or a computer tablet. In another preferred embodiment, the user input includes a virtual or physical computer keyboard of the computing device of the user. Preferably, the user input further includes a virtual or physical point and click device.

In one preferred embodiment, the row of keys on the keyboard represents a range of musical notes and wherein the pitch of each of the range of notes increases with each key moving in a linear direction along the row. In another preferred embodiment, a first row of keys on the keyboard represents a first octave of musical notes and a second row of keys on the keyboard represents a second octave of musical notes. In another preferred embodiment, a row of keys on the keyboard represent a range of musical notes and wherein pressing one of the shift keys on the keyboard changes the octave of the range of musical notes. In another preferred embodiment, each of a plurality of keys on the keyboard is associated with a unique musical note and wherein pressing a chord modifier key on the keyboard reassigns each of the respective plurality of keys to a chord associated with each corresponding musical note.

Preferably, all of the respective musical notes are associated with a song and/or with one of a plurality of tracks associated with a song. In another preferred embodiment, each one of the plurality of tracks is associated with a respective one or more instruments and wherein the sound that is played through the audio output is synthesized to replicate musical notes generated by said respective one or more instruments, wherein the pitch and duration of each musical note corresponds to the respective key pressed and then released by the user.

In another preferred embodiment, each one of the plurality of tracks has an associated difficulty level. Preferably, the user is responsible for playing the musical notes of one of the plurality of tracks of the song and wherein all of the musical notes and vocals of the remaining tracks of the song are synchronized with the user's track and played simultaneously through the audio output.

In yet another preferred embodiment, the user is responsible for playing the musical notes of one of the plurality of tracks of the song and wherein one or more additional users are each responsible for playing the musical notes of another respective one of the plurality of tracks of the song, wherein all of the plurality of tracks are synchronized and wherein all of the musical notes and vocals of any remaining tracks of the song not being played by the user or by the one or more additional users are played simultaneously through the audio output. Preferably, each of the one or more additional users has a respective video display, user input, and audio output and wherein each of the one or more additional users only sees the moving objects on their respective video display corresponding to the musical notes associated with their respective track of the song.

In a feature, the step of providing feedback to the user includes awarding points to the user if the user presses and holds the key corresponding with each respective object as said object crosses the play bar. Preferably, higher points are awarded to the user the closer the front of each respective object is to the play bar when the user presses the corresponding key and the closer the tail of each respective object is to leaving the play bar when the user releases said key. In another preferred feature, the points awarded to the user are displayed on the video display.

In another preferred embodiment, the step of providing feedback to the user includes modifying the appearance of each respective object as a function of how accurately the user presses and holds the key corresponding with the respective object as said object crosses the play bar.

Embodiments of the technology disclosed herein can be implemented in digital electronic circuitry, or in computer hardware, firmware, software, or in combinations of one or more of the above. The technology, systems, and methods described herein may be implemented as a computer program product, i.e., a computer program tangibly embodied in an information carrier, e.g., in a machine-readable storage device or in a propagated signal, for execution by, or to control the operation of, data processing apparatuses, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps described herein can be performed by one or more programmable processors executing a computer program to perform functions or process steps or provide features described herein by operating on input data and generating output. Method steps can also be performed or implemented, in association with the disclosed systems, methods, and/or processes, in, as, or as part of special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are at least one processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with an end user, the technology, systems, and methods described herein, or components or portions thereof, can be implemented on a computer or computing device having a display, e.g., a cathode ray tube (CRT) or liquid crystal display (LCD) monitor or comparable graphical user interface, for displaying information to the user, and a keyboard and/or a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

The technology, systems, and methods described herein, or components or portions thereof, can be implemented in a computing system that includes a back-end component, e.g., a data server, or that includes a middleware component, e.g., an application server, or that includes a front-end component, e.g., a client computer having a graphical user interface or a Web browser through which a user can interact with an implementation of the invention, or any combination of such back-end, middleware, or front-end components. The components of the system can be interconnected by any form or medium of digital data communication, e.g., a communication network, whether wired or wireless. Examples of communication networks include a local area network (LAN) and a wide area network (WAN), e.g., the Internet, Intranet using any available communication means, e.g., Ethernet, Bluetooth®, etc.

The computing system can include clients and servers. A client and server are generally remote from each other and typically interact through a communication network. The relationship of client and server arises by virtue of computer programs running on the respective computers and having a client-server relationship to each other.

The technology, systems, and methods described herein, or components or portions thereof, also encompass computer-readable media having computer-executable instructions for performing methods, steps, or processes, and computer networks and other systems that implement the methods, steps, or processes described herein.

The above aspects, features, elements, components and embodiments as well as additional features and aspects of the technology, systems, and methods described herein, or components or portions thereof, are disclosed herein or will become apparent from the following description of preferred embodiments thereof.

This summary is provided to introduce a selection of aspects and concepts in a simplified form that are further described below in the detailed description. This summary is not necessarily intended to identify all key or essential features of the claimed subject matter, nor is it intended to be used to limit the scope of the claimed subject matter.

BRIEF DESCRIPTION OF THE DRAWINGS

The foregoing summary, as well as the following detailed description of illustrative embodiments, is better understood when read in conjunction with the appended drawings. For the purpose of illustrating the embodiments, there is shown in the drawings example constructions of the embodiments; however, the embodiments are not limited to the specific methods and instrumentalities disclosed. In addition, further features and benefits of the present technology will be apparent from a detailed description of preferred embodiments thereof taken in conjunction with the following drawings, wherein similar elements are referred to with similar reference numbers, and wherein.

DETAILED DESCRIPTION OF PREFERRED EMBODIMENTS

Figure 1:
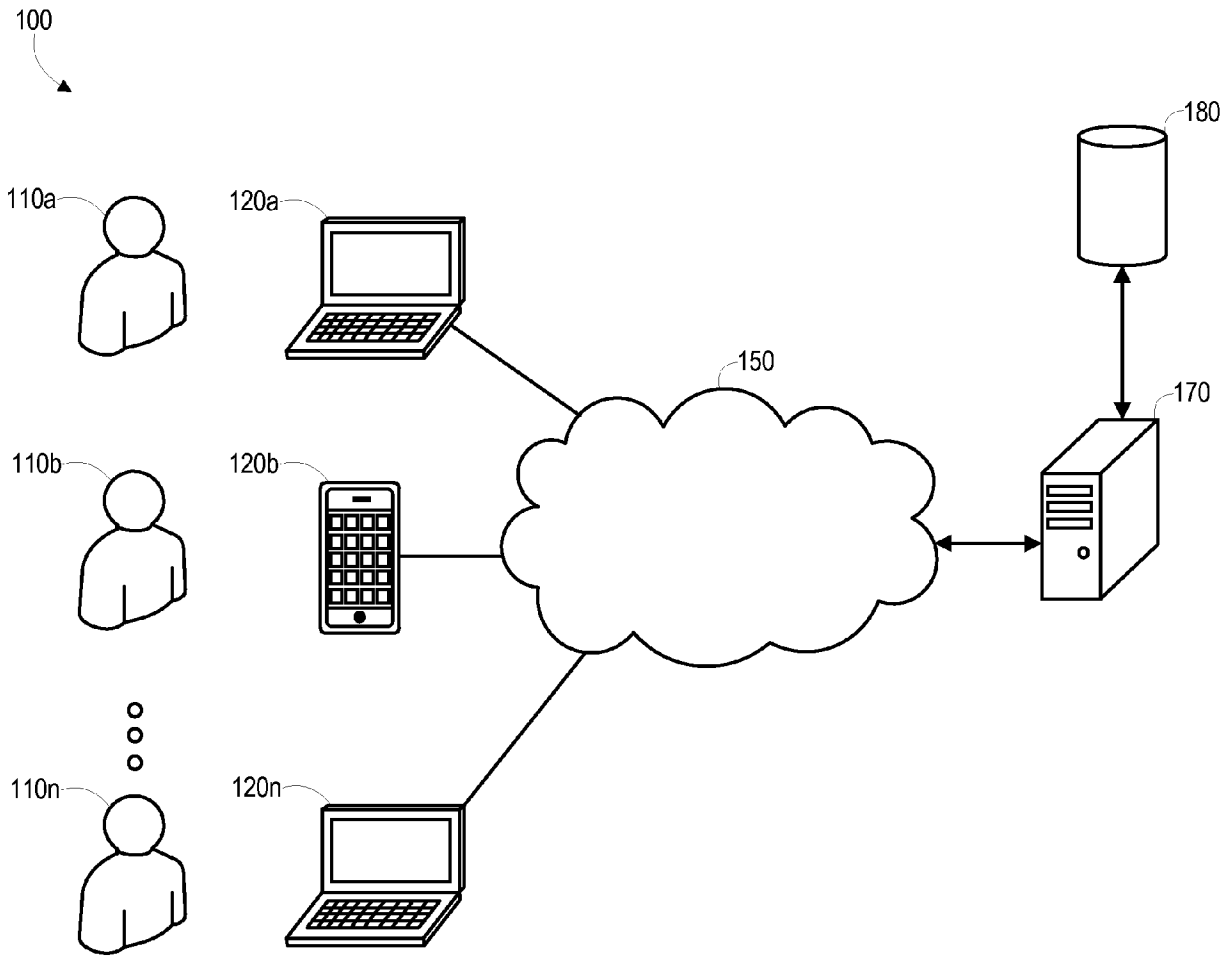
FIG. 1 illustrates an exemplary system configuration for implementing the methods and processes of the present inventions.

Before the present technologies, systems, and methods are disclosed and described in greater detail hereinafter, it is to be understood that the present technologies, systems, and methods are not limited to specific methods, specific components, or particular implementations. It is also to be understood that the terminology used herein is for the purpose of describing particular aspects and embodiments only and is not intended to be limiting.

As used in the specification and the appended claims, the singular forms "a," "an" and "the" include plural referents unless the context clearly dictates otherwise. Similarly, "optional" or "optionally" means that the subsequently described event or circumstance may or may not occur, and the description includes instances in which the event or circumstance occurs and instances where it does not.

Throughout the description and claims of this specification, the word "comprise" and variations of the word, such as "comprising" and "comprises," mean "including but not limited to," and is not intended to exclude, for example, other components, integers, elements, features, or steps. "Exemplary" means "an example of" and is not necessarily intended to convey an indication of preferred or ideal embodiments. "Such as" is not used in a restrictive sense, but for explanatory purposes only.

Disclosed herein are components that can be used to perform the herein described technologies, systems, and methods. These and other components are disclosed herein, and it is understood that when combinations, subsets, interactions, groups, etc. of these components are disclosed that while specific reference to each various individual and collective combinations and permutation of these may not be explicitly disclosed, each is specifically contemplated and described herein, for all technologies, methods, and systems. This applies to all aspects of this specification including, but not limited to, steps in disclosed methods. Thus, if there are a variety of additional steps that can be performed, it is understood that each of the additional steps can be performed with any specific embodiment or combination of embodiments of the disclosed technologies, methods, and systems.

As will be appreciated by one skilled in the art, the present technologies, methods, and systems may take the form of an entirely new hardware embodiment, an entirely new software embodiment, or an embodiment combining new software and hardware aspects. Furthermore, the present technologies, methods, and systems may take the form of a computer program product on a computer-readable storage medium having computer-readable program instructions (e.g., computer software) embodied in the storage medium. More particularly, the present technologies, methods, and systems may take the form of web-implemented computer software. Any suitable computer-readable storage medium may be utilized including hard disks, non-volatile flash memory, CD-ROMs, optical storage devices, and/or magnetic storage devices, and the like. An exemplary computer system is described below.

Embodiments of the present technologies, methods, and systems are described below with reference to block diagrams and flowchart illustrations of methods, systems, apparatuses, and computer program products. It will be understood that each block of the block diagrams and flow illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions, and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

Turning now to the drawings, FIG. 1 illustrates a typical system configuration 100 for use of the methods and technologies described herein. The purpose of the system 100 is to enable one or more users 110 to be able to play or compose music alone or in collaboration with other users, preferably in a game-type environment using a computer-keyboard (real or virtual) as the instrument input, which increases the learning curve and speed by which users 110 are able to learn, play, and compose songs with increasing proficiency. Preferably, the system 100 is managed from a server, web server, or group of servers 170, accessible over the Internet 150 by one or more users 110*a*, 110*b*, . . . , 110*n*, each having one or more computing devices 120*a*, 120*b*, . . . , 120*n*, such as a desktop computer, laptop, handheld device, mobile device, tablet, and the like, that is capable of accessing the server, web server, or group of servers 170 via the Internet 150. Preferably, the server, web server, or group of servers 170 is in electronic communication with one or more databases 180, that are designed to store information or profiles of the one or more users 110*a*, 110*b*, . . . , 110*n* and information about songs available or accessible by the server, web server, or group of servers 170. Preferably, the system 100 includes a computer program or application stored in memory on or accessible by the server, web server, or group of servers 170, that is in electronic communication with a processor, wherein the program or application includes non-transitory computer-readable media, and wherein the computer-readable media has computer-readable instructions which, when executed by the processor, causes the processor to perform the steps of the methods and processes described herein.

In this illustrative embodiment, the systems and methods disclosed herein preferably are provided to the client device(s) 120*a*, 120*b*, . . . , 120*n* or user(s) 110*a*, 110*b*, . . . ,

110*n* of the client device(s) 120*a*, 120*b*, . . . , 120*n* via the Internet 150 in a conventional "software as a service" (SaaS) construction. SaaS, sometimes also referred to as "software on demand," is software and/or one or more computer applications or modules that are deployed and accessible to end users (typically having a UserID and password) over the Internet and/or is deployed to run behind a firewall on a local area network or personal computer or server.

Figure 2:
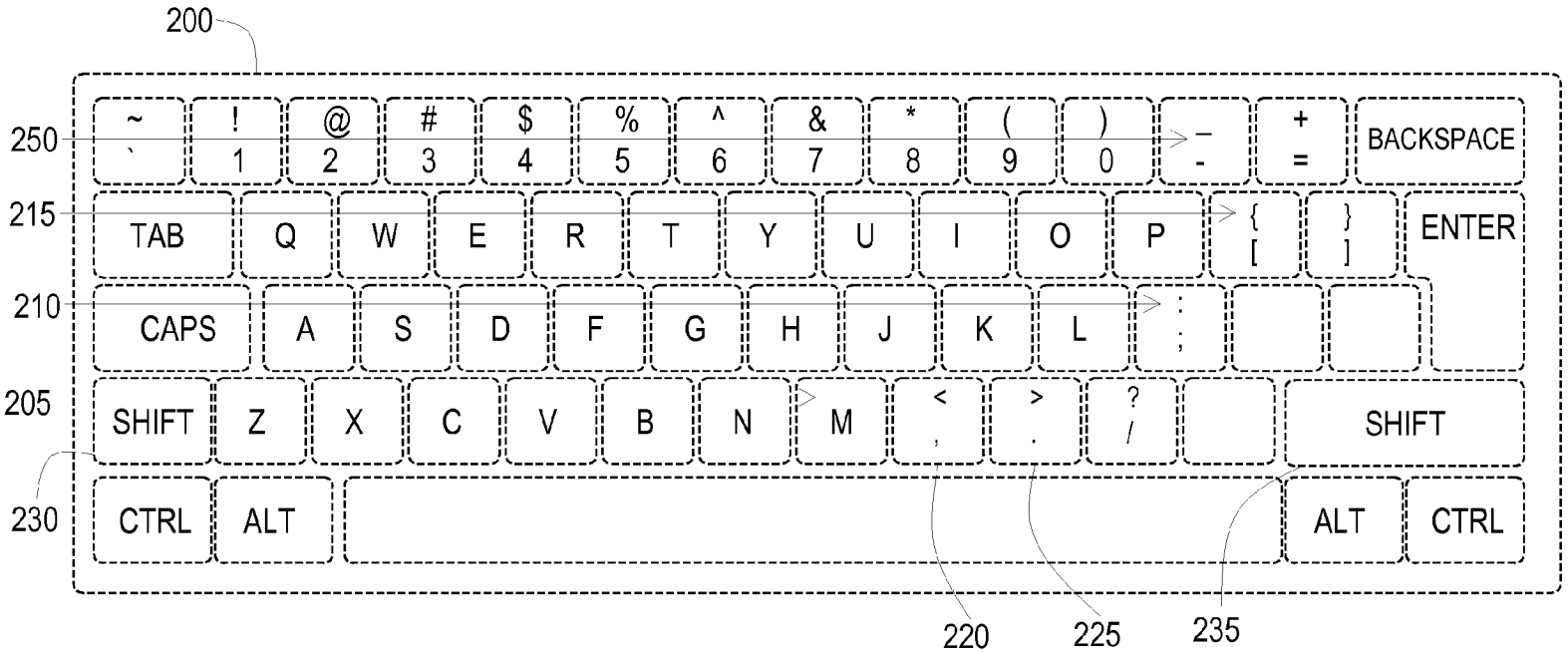
FIG. 2 illustrates an exemplary keyboard for use as an input device in accordance with the system of FIG. 1.

To interface with the server, web server, or group of servers 170, each computing device 120 preferably includes a computer or alpha-numeric keyboard (real or virtual; hardware equipment, raised buttons on a hand-held device, or electronically displayed on a computer screen) 200. As shown in FIG. 2, each key of the keyboard 200 is associated with a specific musical note. The actual note or octave of the note associated with each key on the keyboard is based on the particular song being played or recorded, as will be discussed in greater detail hereinafter. Preferably, each specific song played or recorded within the system 100 has a default relationship between specific musical notes and specific keys on the keyboard 200, but this default relationship can be changed or modified by a user, to some extent, particularly in aspects of the system that allow a user or group of users to create their own music or songs.

The computer keyboard or virtual keyboard 200 is the foundation for all notes that are played, within the system 100, as well as created in the create music section of the system 100. FIG. 2 illustrates a typical US-style computer keyboard; however, the system 100 can be configured to work with any type or style of computer keyboard used anywhere in the world, such as French, German, Kanji, etc., using the basic concepts described herein.

In addition, it should be understood that the computer keyboard 200 can be used configured as a musical note input device for any type of instrument having a sound that can be reproduced or synthesized by a computer, having a suitable sound card and audio output capabilities, such as speakers. This could be any musical instrument, such as a piano, organ, guitar (acoustical, electric, bass, etc.) violin, drums, clarinet, saxophone, synth device, etc. Each musical note that an instrument can play is then mapped to the computer keyboard. As stated above, each instrument preferably has a default mapping relationship between its notes and specific keys on the keyboard, but such default mapping relationship may vary by song (depending upon the scale in which the song is written for that instrument track) or may be customizable or modifiable by a user, as described in greater detail herein.

While there are certainly other methods that the system may employ for mapping specific musical notes to specific keys on a computer keyboard 200, the system preferably uses the following as its default mapping arrangement for a US-style keyboard: just over two octaves can be mapped, in which the Z key is mapped to the lowest note that is used by a particular instrument (or by a particular instrument for a specific song), and then the musical notes increase in pitch or frequency on a diatonic scale along the same row of keys that extend from left to right on the keyboard. For example, the lowest notes of the instrument start at key Z and move across that row 205 of the keyboard, using the following keys: Z, X, C, V, B, N, M. The next range of notes continue on the next higher row 210 of the keyboard and include the following keys: A, S, D, F, G, H, J, K, L, and ";". In a preferred embodiment, notes that are not in the scale (chromatic notes) of a particular song are mapped, in increasing frequency, on the next higher row 215 of the keyboard and may include the keys: Q, W, E, R, T, Y, U, I, O, P, "[", and "]".

Since two (2) octaves is a limiting range, depending on the song being played, the lowest and highest note are preferably and automatically adjusted to the required pitch of each respective song for which the keyboard is mapped. In addition, there are modifier keys that allow for an additional two (2) octaves of notes in either direction; thus, allowing for a total of slightly over a six (6) octave range. For example, the left shift key 230 preferably shifts the note registered when a specific key is pressed for a pitch exactly two octaves lower, whereas the right shift key 235 preferably shifts the note registered when a specific key is pressed for a pitch exactly two octaves higher. The exactness of shifting two (2) octaves is to keep each key mapped to something that makes sense from a musical perspective. For example, pressing "left shift" in combination with the A key would be mapped to exactly two octaves lower than the note generated by just pressing the A key without pressing the "left shift" key; thus, allowing for a harmonious nature of the keyboard as an instrument. In one embodiment, it is necessary for the shift left or shift right keys 230, 235 to be pressed at the same time as one of the musical note keys, in order to generate the desired note at a lower or higher octave. In other embodiments, pressing the shift left key 230 or shift right key 235 merely shifts the next note played up or down two octaves, even if the shift left or shift right key is not pressed at the same time as the note key. In yet a further embodiment, pressing the shift left key 230 or shift right key 235 shifts all notes for all keys on the keyboard down or up two octaves until the same key is pressed again or until the other shift key is pressed, which has the same effect of returning all keys to their default octave position.

In addition, if a song requires a greater range of notes than are available from the initial two octave scale and if not all notes within the two octave scale are needed by such song, then it is possible for keys on the outer boundaries of each row 205, 210 to be mapped to lower (or higher) octave notes in either direction (i.e., at either end of the respective row 205, 210) that are required by the song. For example, the Z key could be mapped to a note many steps lower than the expected low note by the scale the song is in; the X key could be mapped many steps lower than the expected low second lowest note on the scale, but would always be a note higher than the Z key, since it is placed to the right of the Z key. Thus, it is not necessary, for a particular song, that each key next to another key represents the next key in the scale. However, it is preferable that keys from left to right correlate with lower to higher notes. As will be appreciated by those with skill in the art, the left to right key correlation with lower to higher notes is preferred for those countries in which words or language is generally read from left to right. In countries in which words or language is read from right to left, it may be more intuitive for lower notes to correlate with keys on the right side of the keyboard and then for notes to increase in scale as one moves across the keyboard rows from right to left. Chromatic notes along row 215 can be configured to follow the same pattern in which keys at either end of the row are mapped to notes that may, in fact, be higher or lower in octave than would be expected. Note also that, in some embodiments, the numeric row 250 of keys can also be used as an additional (higher) scale of notes.

Chords can also be played and mapped within the system 100 by simultaneously pressing multiple keys, associated with the notes of the particular chord, at the same time. Alternatively, chord modifier keys 220 or 225 may be used in the same manner as the shift left and shift right keys 230, 235, to generate a chord when just one note key is pressed. The "less than" key '<' 220 is associated, intuitively, with a minor chord, whereas the "greater than" key '>' 225 is associated, preferably, with a major chord. As will be appreciated by those of skill in the art, additional chord modifiers could be added to the system for $7^{th}$ chord variations, $6^{th}$ chords, suspended chords, slash chords, diminished chords, etc.

By having chords mapped using a simple chord modifier key 220, 225, it is easier for a user 110 to master and play chords without simultaneously having to press multiple keys that make up a chord on the computer keyboard 200. This allows users to not only play the game with easier mastery, but also allows the creation of music that sounds fantastic in short order.

By using the above note to key mapping techniques, it is very intuitive for a user 110 to learn how to play any song. Since most users are familiar with typing on a computer keyboard 200, when a user 110 is presented with a note of the song (represented on-screen as a key on the computer keyboard), it is easy for the user to "type" that note for the song. As the user 110 gets more experienced with the system 100, the user 110 learns that the duration of each note can be controlled by how long the key is pressed and held down on the keyboard 200.

In one embodiment, if the computer keyboard 200 is configured to detect the amount of pressure applied to each key (or how hard each key is pressed), the system 100 can make use of such data to adjust the volume of the note applied in response to how hard the key on the keyboard is pressed. For example, the harder a key is pressed, the louder the note would be. The methods for volume adjustment could vary in complexity based off of instrument and implementation of the invention. In such embodiments, the desired volume at which a note should be played can be illustrated to the user 110 on screen by modifying the size of the corresponding key on the keyboard 200. Learning a suite of songs comes quickly and naturally using the present system 100.

Figure 3:
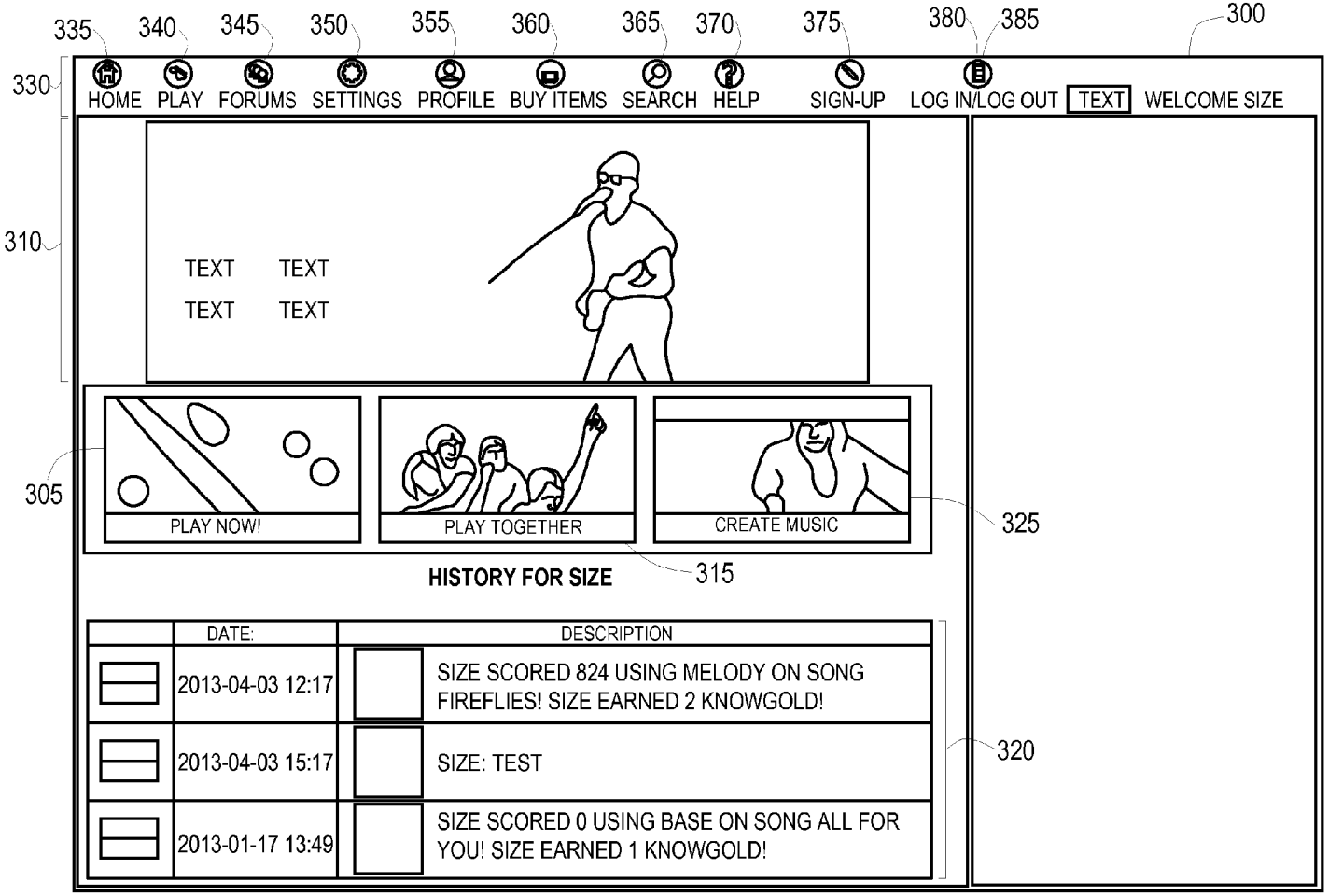
FIG. 3 illustrates a main user interface screen or Home Page screen used with the system of FIG. 1.

FIG. 3 illustrates the main user interface screen or Home Page screen 300 through which each user 110 interacts with the system 100. The Home Page screen 300 is typically the "default" or main screen that registered users are taken to after logging-in to the system 100. The Home Page screen 300 includes a main information window 310 that displays notes or other important system information to the user. The middle of the Home Page screen 300 includes three main selection buttons/windows: Play Now! 305, Play Together 315, and Create Music 325. Selecting the Play Now! 305 button launches the Song Selection screen 400, shown in FIG. 4. Selecting the Play Together 315 button launches the Multi-User Game screen 800, shown in FIG. 8. Selecting the Create Music 325 button launches the Create Music screen 1000, shown in FIG. 10. Below the main selection buttons is a list of history 320 for the current logged-in user. This history allows the user to share any award score, or note, on social media, such as Facebook®, Twitter®, or the like. At the top of the Home Page 300, a navigation bar 330 includes a number of typical navigation buttons, such as Home Page 335 button, which returns the user to the Home Page 300 screen (or reloads the Home Page 300 screen, if that is where the user is already located). The Play 340 button launches the Song Selection screen 400, shown in FIG. 4, and takes the user to the same screen as the Play Now! 305 button. The Forums 345 button takes the user to a conventional bulletin board or similar user forums' interaction page (not shown). The Settings 350 button takes the user to a conventional settings page (not shown) from which the user is able to modify or customize the user's personal choices for use of the system. The Profile 355 button takes the user to a User Profile screen 1300, shown in FIG. 13, from which the user is able to modify or customize the user's personal profile within the system, as will be described in greater detail hereinafter. The Buy Items 360 button takes the user to a conventional, virtual items store (not shown) from which the user is able to purchase special or customized instruments are able to use real money to purchase items from the virtual store. In addition, users can earn virtual currency within the system based on amount of time spent on the system and/or based upon attaining expertise within the system. The Search 365 button allows the user to search the system for specific songs to play, specific pages within the system that are accessible by the user, or other users registered or logged into the system. The navigation bar 330 further includes a sign-up 375 or log-in 380 button. Alternatively, after a user has logged in, the navigation bar 330 replaces the sign-up 375 and log-in 380 buttons with a conventional log-out 385 button.

Figure 4:
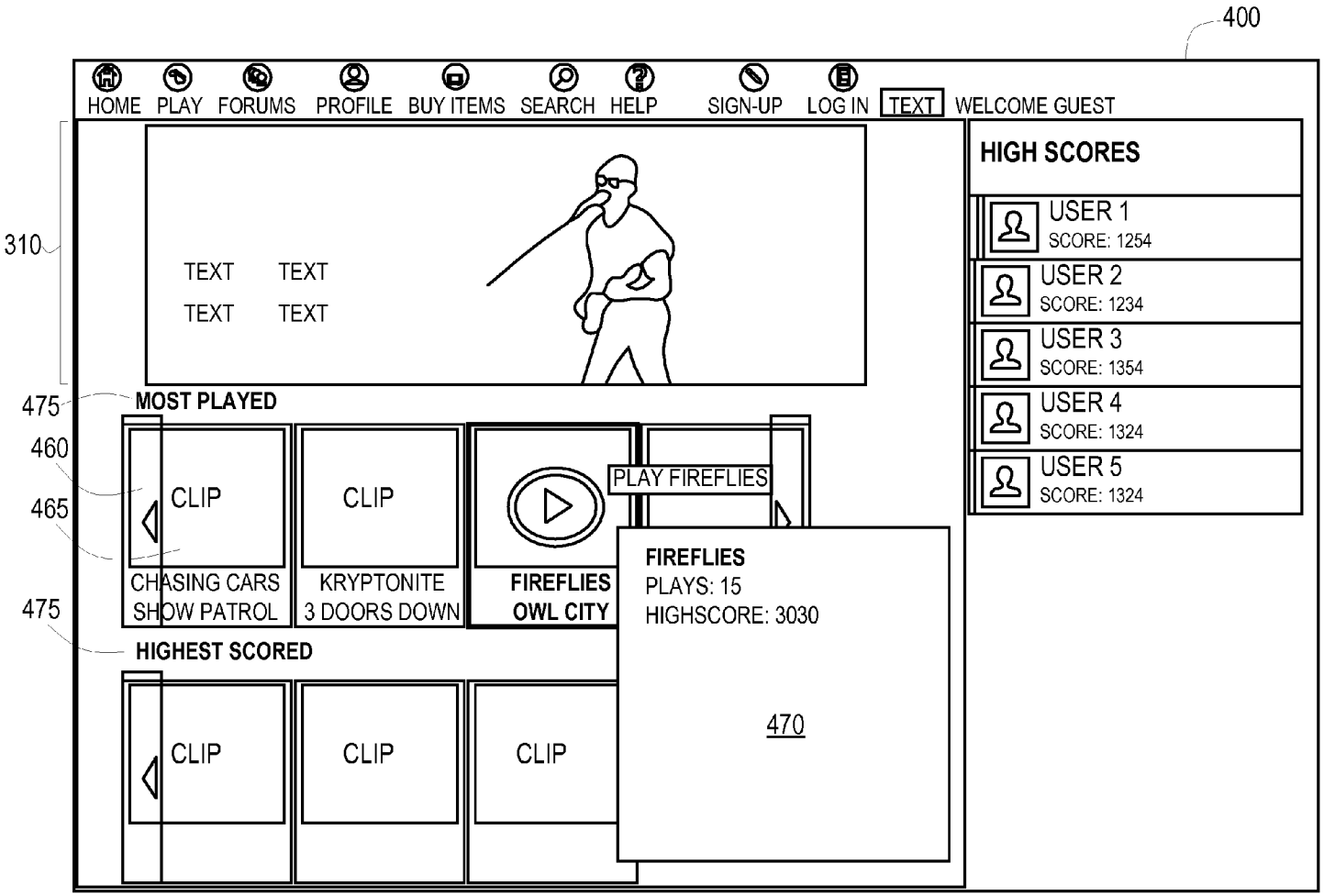
FIG. 4 illustrates a Song Selection screen used with the system of FIG. 1.

Turning now to FIG. 4, Song Selection screen 400 is illustrated. The Song Selection screen 400 is typically accessed by selecting the Play Now! 305 button from the Home Page screen 300 from FIG. 3. Preferably, the Song Selection screen 400 is considered the "default" main screen that guests, unregistered users, or registered users who have not yet logged in are taken to when first accessing the system 100. The Song Selection screen 400 includes the same main information window 310 that displays notes or other important system information to the user. Below the main information window 310, the user is presented with a plurality of songs, each shown as its own graphic button 465, that can be played within the system. Each graphic button 465 includes an image, the song's title, and the song's artist. Preferably, and in conventional manner, the plurality of songs that can be played by the user are arranged into a variety of groups 475, such as "Most Played" songs, "Highest Scored" songs, "Most-Recent" songs, and "All" songs. Based on the user's settings, such groups may represent the "Most Played," "Highest Scored," and "Most-Recent" songs of the user or of all users of the system. In addition, songs may be presented alphabetically, by genre, by year, by artist, by difficulty level, by search results, or by any other criteria. The user is able to scroll up and down within this Song Selection screen 400 to view the different groups of songs. Within each group of songs, the user is able to scroll left or right (using arrows 460 or the like) to view songs within that group that cannot be displayed at the same time on the Song Selection screen 400. If a particular song is scrolled over or viewed using a single (or right) mouse click, more details of the song may be displayed in pop-up window 470. If a particular song is selected using a double (or left) mouse click, the user is taken to Instrument Selection screen 500, as shown in FIG. 5.

Figure 5:
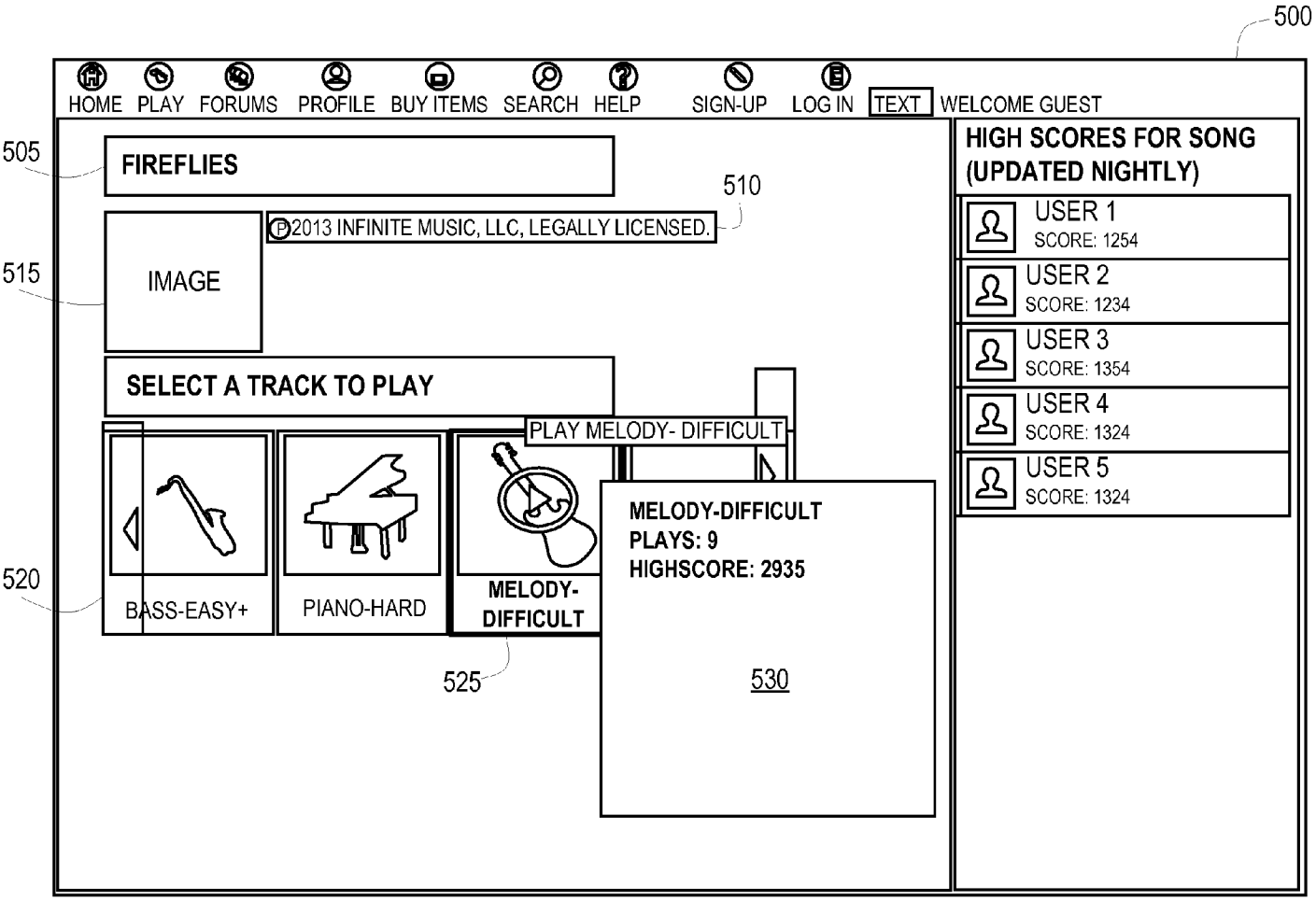
FIG. 5 illustrates a Instrument Selection screen used with the system of FIG. 1.

Turning now to FIG. 5, Instrument Selection screen 500 presents the user with the list of instruments available to the user that may be played in conjunction with the specific song previously selected by the user from the Song Selection screen 400. The song name for the previously-selected song is displayed in the header 505. Song details 510, such as copyright, sound-recording copyright (or phonocopyright), composer, artist, publisher, distributor, owner, etc., may also be provided near header 505 or in a pop-up window (not shown) when the user clicks on or scrolls over the header 505. The image (or one of a plurality of images) associated with the selected song may be displayed within window 515. As will be explained in greater detail hereinafter, one or more "tracks" associated with the selected song are each associated with one or more instruments available for play by the user. Preferably, each song includes one or more tracks associated with the lyrics or vocals of the song. Such vocal tracks are generally similar to the vocal tracks available in karaoke systems, and may be included with the present system— although they are not the focus of the present disclosure. Rather, for each song, there are preferably one or more instrumental tracks that have been created and synched with the lyrics to make up a complete rendition of the song. Typically, at least one of the instrumental tracks will be associated with the melody. Other instrumental, non-melody tracks are preferably also available for play by the user. In operation, when a song is played by the system, the user will be solely and completely responsible for playing the instrumental track of the song—based on the instrument selected by the user. The system will play and provide the vocals and all other instrumental tracks not chosen by the user. The list of available instruments are preferably each displayed as its own graphic button 525. Each graphic button 525 includes an image of the instrument, the name of the instrument, and the difficulty level (e.g., beginner, easy, medium, moderate, difficult, very difficult, expert, or the like) of the track associated with that instrument for that selected song. If all of the instruments cannot be displayed on the Instrument Selection screen 500 at the same time, then the user is given the ability to scroll left or right through the list of available instruments in conventional manner. If a particular instrument is scrolled over or viewed using a single (or right) mouse click, more details of the instrument may be displayed in pop-up window 530. If a particular instrument is selected using a double (or left) mouse click, the user is then taken to the Individual Game Play screen 600, as shown and discussed in association with FIGS. 6-7.

Figure 6:
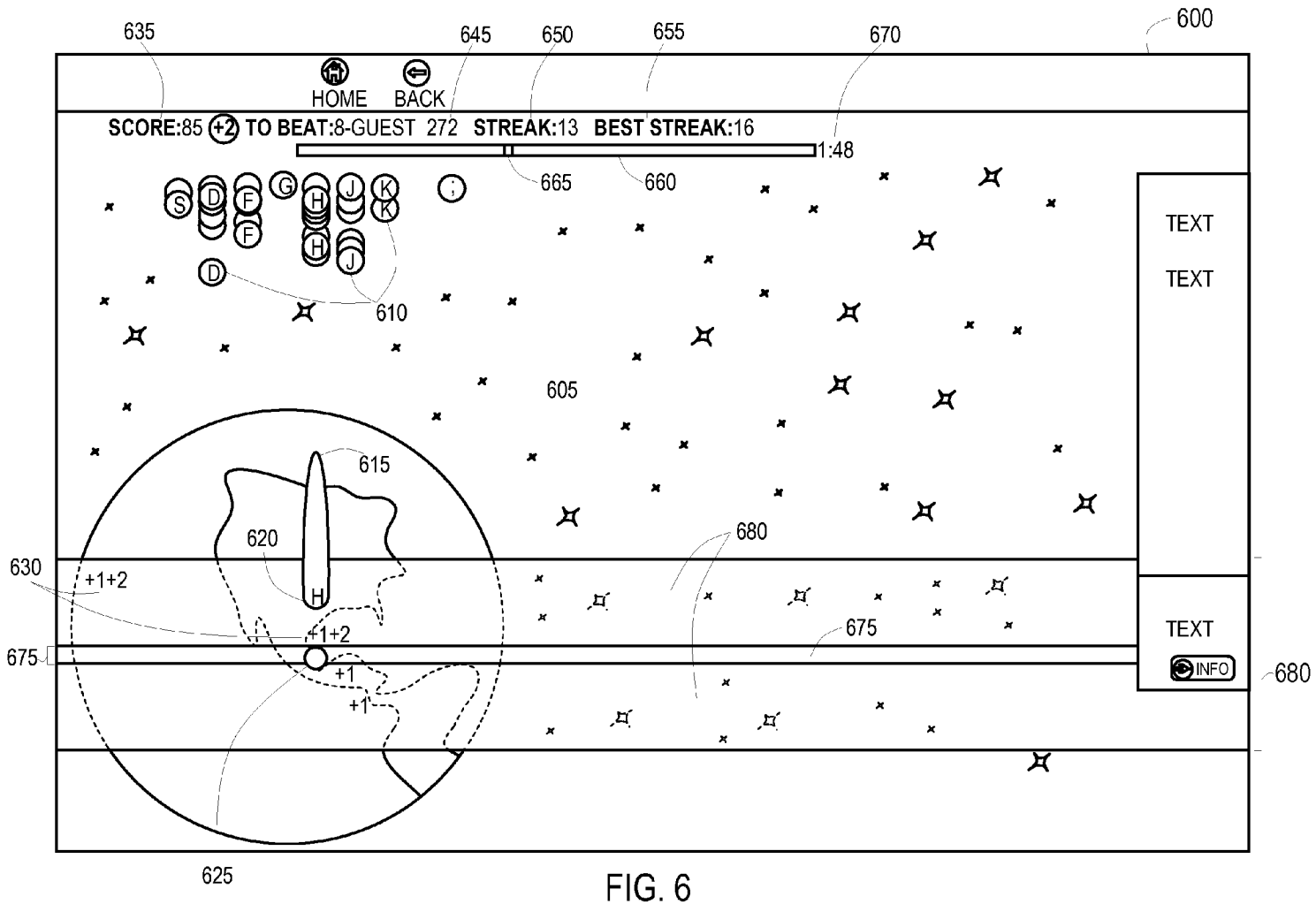
FIG. 6 illustrates one exemplary embodiment of the Individual Game Play screen used with the system of FIG. 1.

FIG. 6 illustrates one exemplary embodiment of the Individual Game Play screen 600. The Individual Game Play screen 600 preferably includes a background still or animated image 605 (such as, in this example, planet Earth with stars). Such background image 605 can be a solid color or any other image selected by the system 100 or customized by the user 110. In the embodiment shown, notes of the track associated with the selected instrument for the song selected by the user are shown as comets 610, represented by colored circles with a letter shown therein. The letter in the circle corresponds with the letter on the user's computer keyboard or virtual keyboard that should be pressed or depressed to play the correct note from the song track. A play bar 675 is used to provide the timing, within the song track, for when the note should be played by the user. In this embodiment, notes start at the top of the screen 600 and then fall down the screen toward the play bar 675. In practice, the user should try to press and release the key on the keyboard when the body of the comet is fully within the play bar 675—this is typically equivalent to a quarter note. If the note is longer than a quarter note, then it is represented graphically within the system as the body of a comet having an elongated tail 615. Thus, to play a note that is longer than a quarter note, the user should press the appropriate letter on the keyboard when the head of the comet is fully within the play bar 675 and hold the key down until the end of the elongated tail 615 passes into the play bar 675. For purposes of the game, points are awarded for pressing the correct key at the correct time. Additional points are awarded if the user holds the appropriate key for the correct amount of time—when the end of the tail enters the play bar 675. For purposes of the game, there is preferably a larger band 680 that extends on either side of the play bar 675. The larger band 680 enables users to obtain game points when the user presses the correct key when the comet is within the larger band, but not perfectly within the play bar 675. The user can also still get extra points for holding the key down for the correct amount of time, even if the key is pressed when the comet is within the larger band, but not within the play bar. In one embodiment, the comet, when the correct letter is pressed when the comet is within the larger band, gets an animated effect 625 (e.g., turns into a fireball, changes color, emits sparks, or provides other similar visual feedback) so that the user knows that the proper key has been pressed at the appropriate time. Similarly, the comet, when the correct letter is pressed but the comet is not within the larger band (i.e., if the correct letter is pressed too early or too late in time), then a different effect may be used, such as burning the comet head out, turning it black, or causing it to pop out of existence. In one embodiment, the points awarded 630 to the user by the system for each note correctly played can pop up on the screen and drift off the screen 600 with or just behind the comet.

The user's running score 635 for the current song is displayed on the screen. Preferably, the next score 645 the user is about to beat from the high scores list is also displayed. Although not shown, the user's previous high score for that song can also be displayed on the screen 600. The number of notes 650 correctly played by the user, as well as the best streak 655 of notes correctly played in a row, for the current song are also displayed at the top of the screen 600.

A progress bar 660 displays the timeline for the current song, from time 0:00 to time mm:ss 670, where "mm:ss" indicates the duration of the song in minutes (mm) and seconds (ss). A scroll thumb 665 travels along the progress bar 660 as the song plays. The user can click and drag the scroll thumb 665 to any point in time for the song, if desired.

Figure 7:
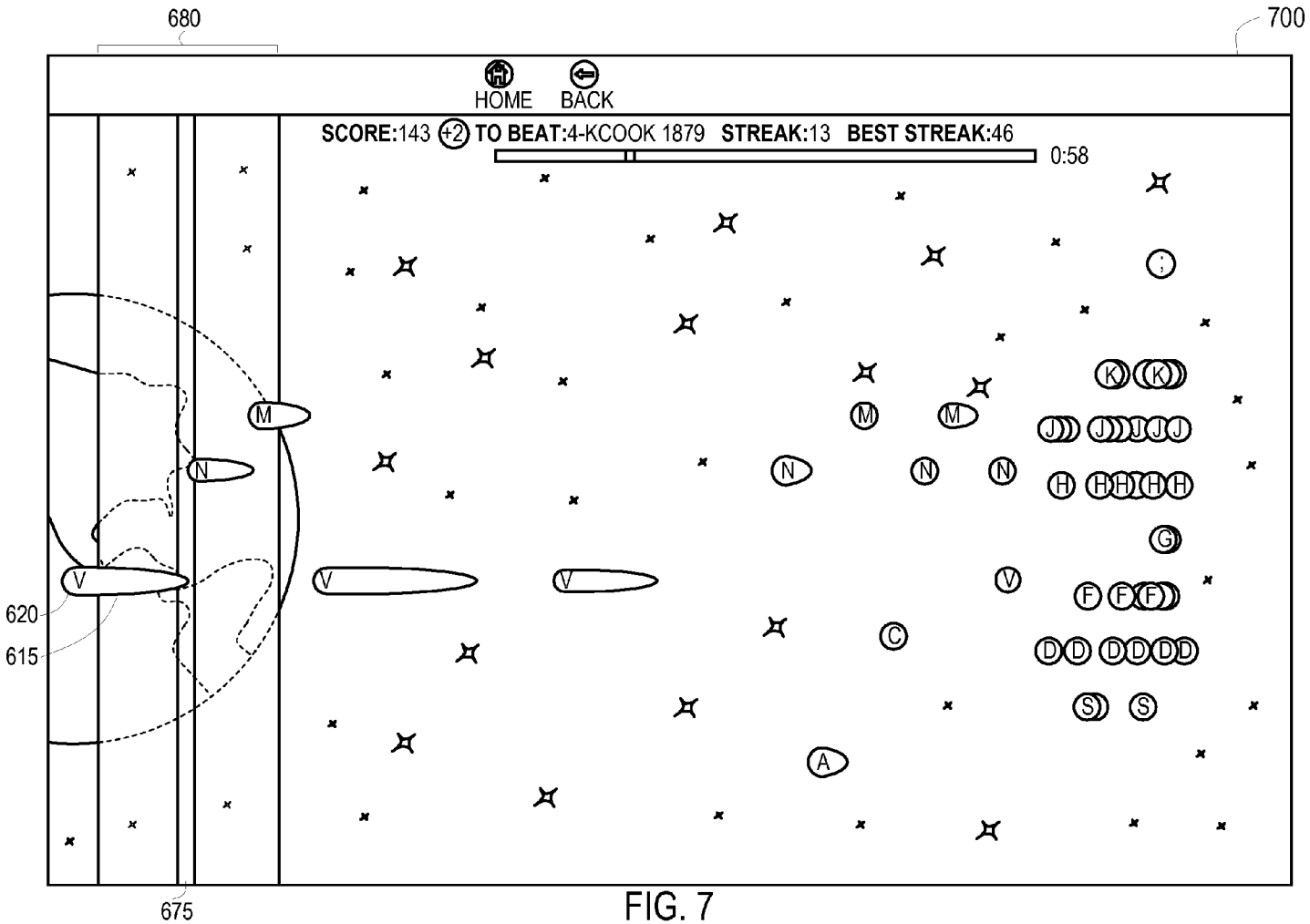
FIG. 7 illustrates another exemplary embodiment of the Individual Game Play screen used with the system of FIG. 1.

It should be noted that there are many variations to the game screen appearance and presentation style that can be used. For example, as previously stated, the background appearance can be any image used by the system or selected by the user. Further, although a circle or a circle with a trailing tail (described above as a comet) can be used, notes and the corresponding letter on the keyboard that needs to be pressed by the user can be depicted in a wide variety of manners. For example, the keyboard letter does not have to be within a comet head or any other object. The letter can float by itself and have one or more trailing mirror images of the letter following behind the main letter, where the length of the trailing images indicates how long the note needs to be played. Alternatively, instead of a comet, the letter can be embedded within another object with any suitable tail, such as a balloon, bubbles, blocks, rain drops, vehicles, flowers, or any other desired object or shape, as will be appreciated by those of skill in the art. In one embodiment, the specific object may be selected by default by the system, may be selected by the system based on the profile (e.g., age, sex) of the user, or may be chosen by the user within the system settings. It should also be noted that the location of the play bar can be almost anywhere on the screen 600. Further, the direction of movement of the notes can be in any direction—from left to right on the screen, from right to left on the screen, from top to bottom on the screen, from bottom to top on the screen, in a circular or spiral pattern, in a wind-drift pattern, or any other recognizable pattern on the screen. FIG. 7 illustrates an embodiment different than the one shown in FIG. 6. For example, in FIG. 7, the screen 700 illustrates an embodiment in which the comets move from right to left toward a play bar that extends vertically along the left side of the screen 700.

Figure 8:
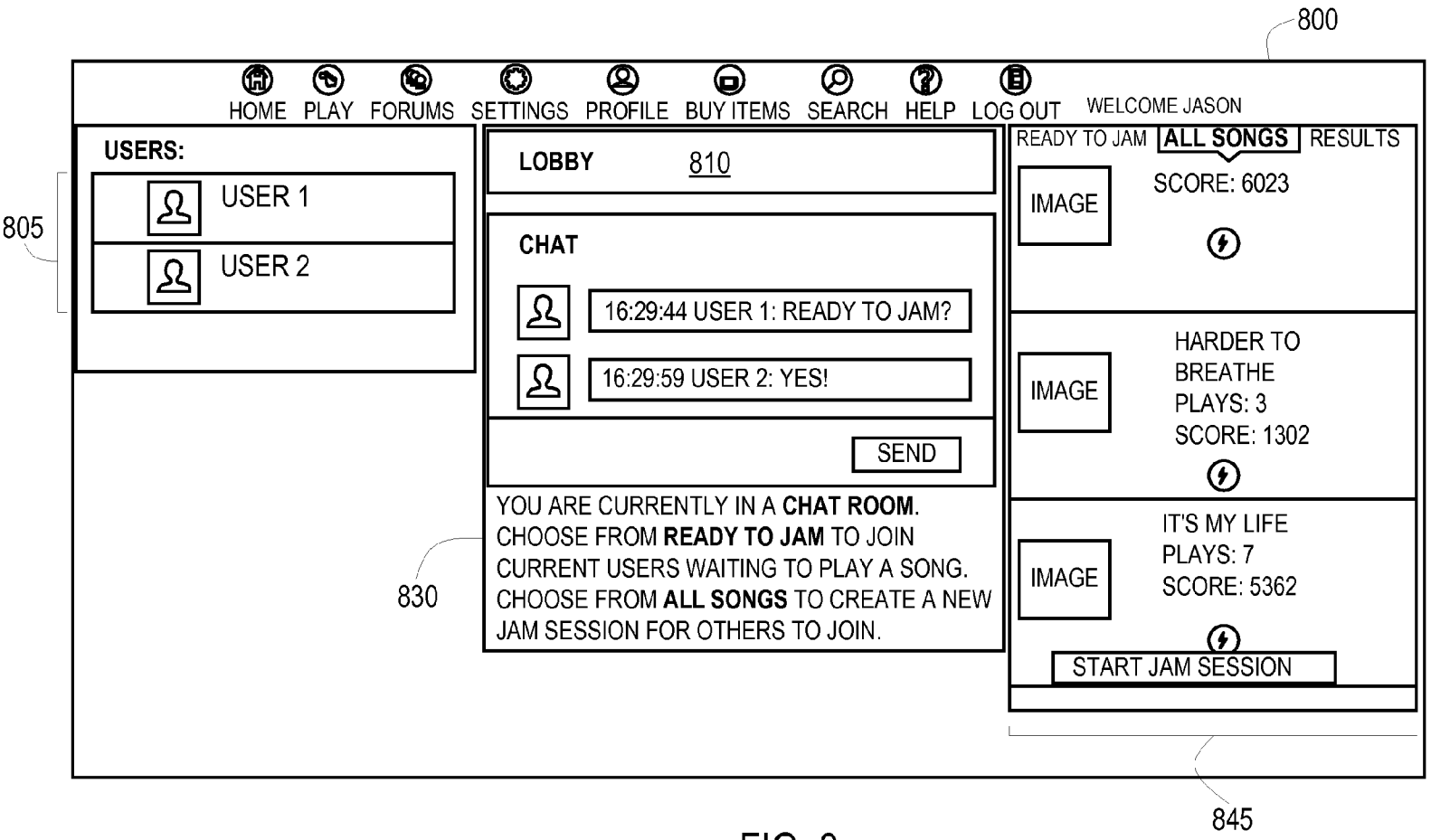
FIG. 8 illustrates a Multi-User Game screen used with the system of FIG. 1.
Figure 9:
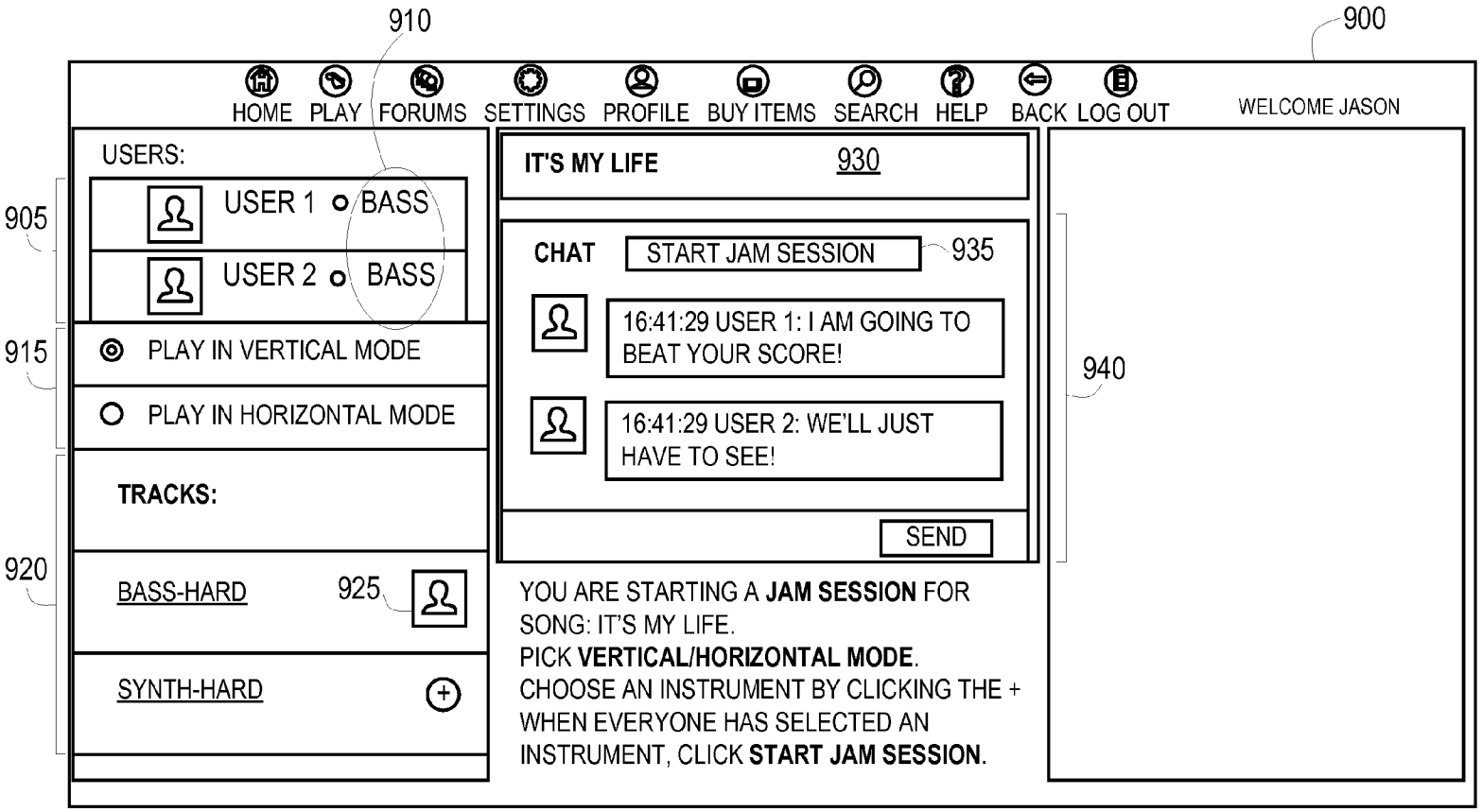
FIG. 9 illustrates a Multi-User Game "Jam Session" screen used with the system of FIG. 1.

The Multi-User Game screen 800 is shown in FIG. 8. As stated previously, the Multi-User Game screen 800 is accessed when the user selects the Play Together 315 button, as shown on Home Page 300 from FIG. 3. The Multi-User Game screen 800 is basically a lobby within which the user is able to interact with other on-line users logged-in or otherwise engaged within the system. A list of users in the lobby is shown in column 805 on the screen 800. The name of the specific chat room in which the user is currently located is displayed in the top header 810. The main chat area for users to communicate within the current chat room is provided in the center window 830. The column 845 on the right side of the screen identifies those songs for which users are waiting for additional users to join to participate in a multi-use jam session. Alternatively, a user can select a song to start a new jam session once enough other users decide to join that group. When a specific song is selected from column 845, the user is directed to a "Jam Session" room, as shown on screen 900 in FIG. 9.

Screen 900 illustrates the "Jam Session" room. The list of users 905 waiting to play the song associated with that "Jam Session" room is displayed in the left column. When the user chooses an instrument 910 to play, it is listed next to the user's name. The user chooses the mode 915 in which to play the game, such as horizontal or vertical. From the tracks selection area 920, the user chooses an instrument to play. The user's icon 925 is displayed next to whichever instrument the user chooses. The name of the song is listed as the top header 930.

Once all of the users waiting to play the song have chosen an instrument to play, the Start Jam Session 935 button appears for any user to click to initiate the Jam Session. Once any user clicks it, all users will begin the Jam Session for that song. Each user is presented with a game play screen similar to the Individual Game Play screen 600 from FIG. 6. The notes for each user is presented on their own screen; however, the song timeline for all users in the Jam Session are synchronized and, in a preferred embodiment, each user can hear the notes being played by all of the other users in the Jam Session in real time. In an alternative embodiment, it is possible for each user to hear all of the other instrument tracks played perfectly by the system while they are playing their own part and then, after the song has been played by all users, the Jam Session can be replayed with the actual input by each user of the Jam Session so that all of the users can hear the results of their compilation. Preferably, during the Jam Session, the scores and performance of the other users is displayed in real time. In some embodiments, the users are able to chat (by text) (shown in window 940) or talk with other system users via headset with headphones and a microphone. After a Jam Session, users are able to remain in the Jam Session window to continue chatting or communicating with other users, and can replay or save the Jam Session. Once finished within the Jam Session, the user is able to return to the Multi-User Game screen 800 from FIG. 8 or the Home Page screen 300 from FIG. 3.

Figure 10:
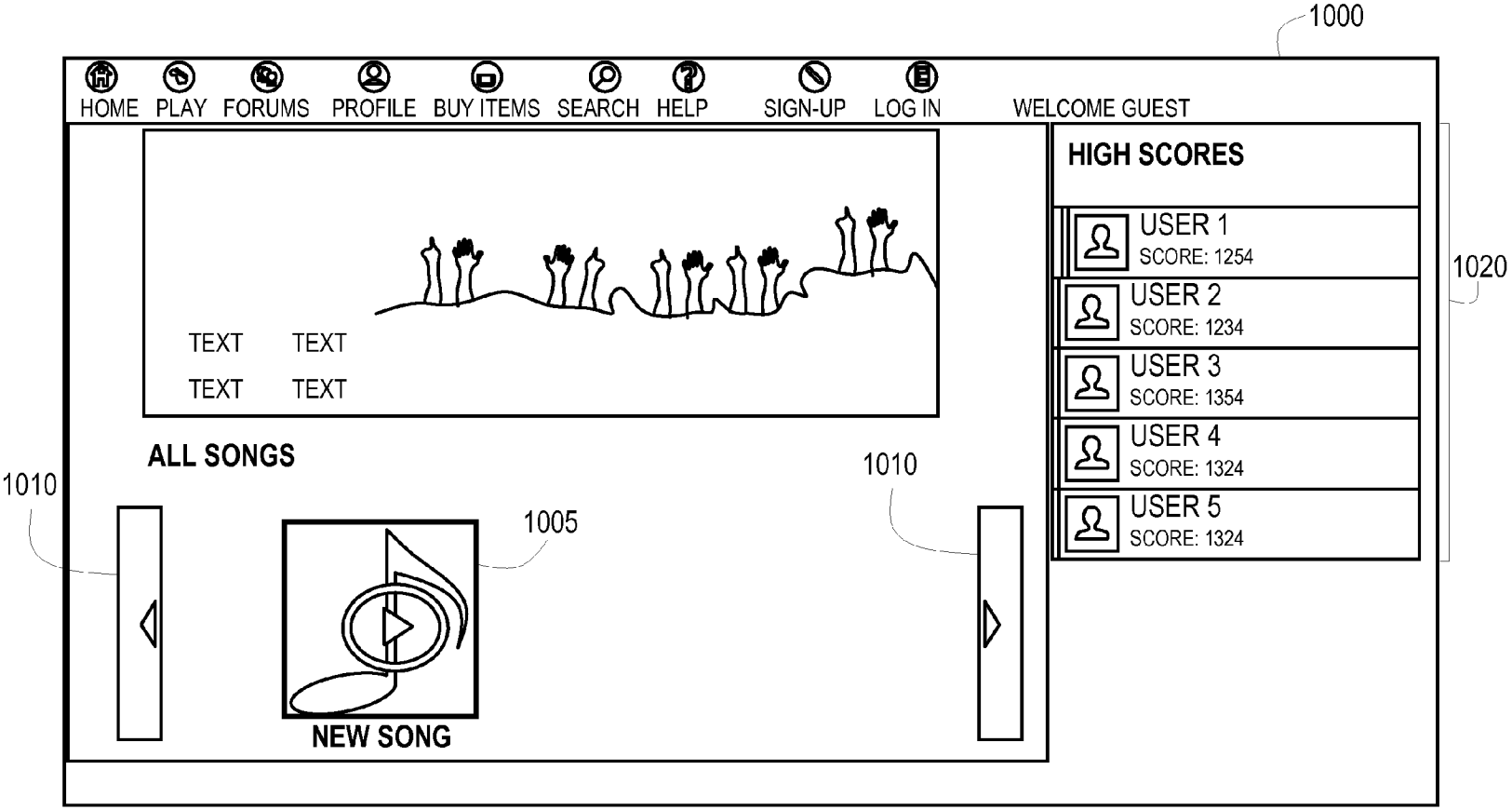
FIG. 10 illustrates a Create Music screen used with the system of FIG. 1.

The Create Music screen 1000 is shown in FIG. 10. As stated previously, the Create Music screen 1000 is accessed when the user selects the Create Music 325 button, as shown on Home Page 300 from FIG. 3. The Create Music screen 1000 allows the user to choose from an existing song shown in right hand column 1020 that the user has previously created or started working on, or the user can select the New Song button 1005 to start creating a new song from scratch. If the user has many saved songs, they can use the scrollers 1010 to scroll through the list of songs that the user has previously created.

Figure 11:
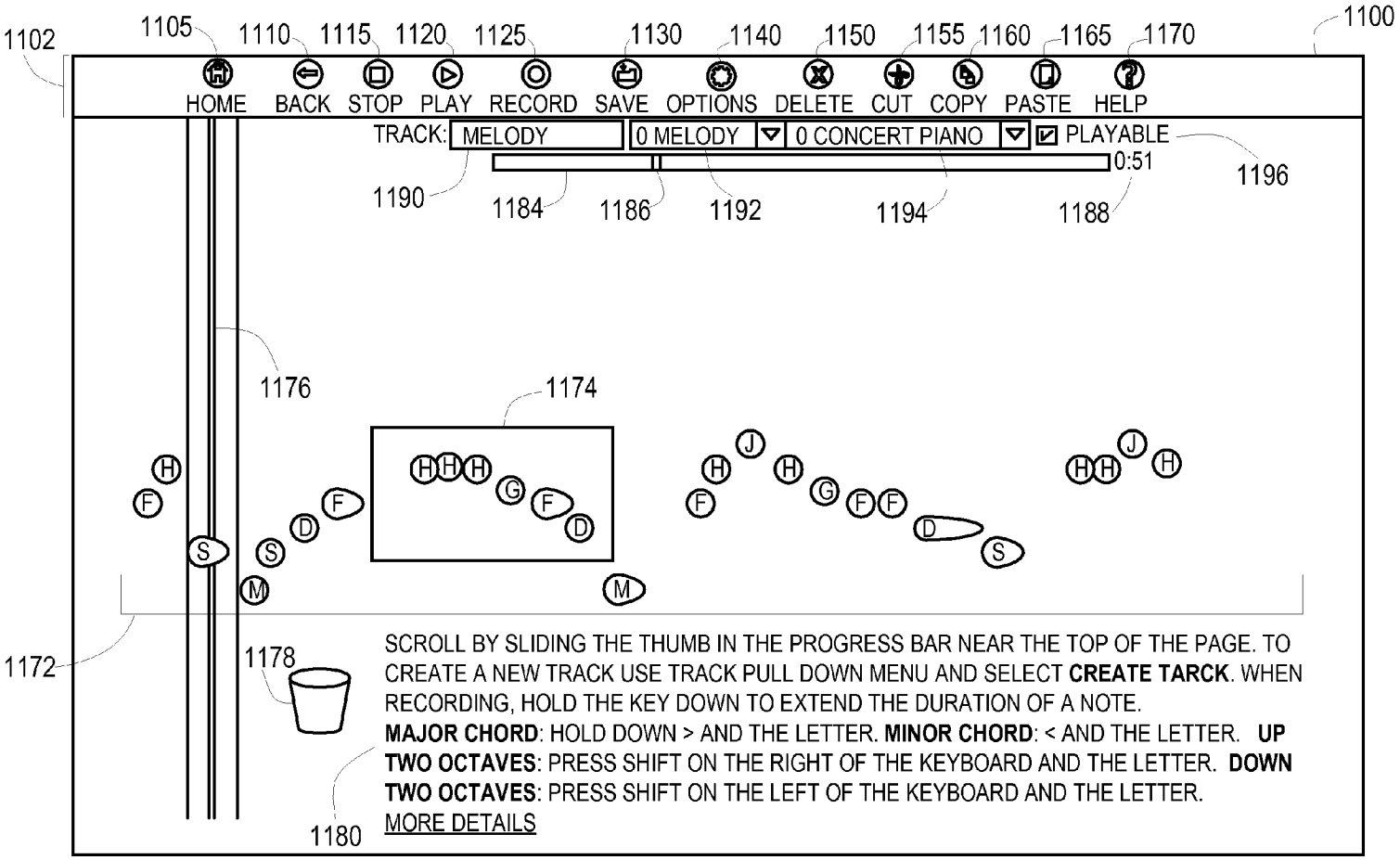
FIG. 11 illustrates a Custom Song screen used with the system of FIG. 1.

Once the user has selected to create a new song or to work on an existing song, the user is presented with Custom Song screen 1100, shown in FIG. 11, which is the primary interface for the music creation module. The main heading bar 1102 illustrates the various buttons used for all command operations within the music creation module. Only the Home 1105 button and the Back 1110 button exit the music creation module. The Home 1105 button, like the Home button on other system screens, returns the user to the Home Page screen 300 of FIG. 3. The Back 1110 button brings the user back to the Create Music screen 1000 shown in FIG. 10. The Stop 1115 button stops music from playing or recording. The Play 1120 button starts the music playing, and the user will see all notes on the main screen area 1172 scroll toward the play bar 1176, in this case, which is on the left side of the screen 1100. Unlike in the previously-described Play mode, the system will generate and play each respective note when it hits the play bar 1176. Each note will continue to play until the tail of the note finishes passing through the play bar 1176. Thereafter, after being played/passing through the play bar 1176, each note will continue off the screen 1100 and/or fade away.

As with the game in Play mode, in Record mode, a progress bar 1184 displays the timeline for the current song, from time 0:00 to time mm:ss 1188, where "mm:ss" indicates the duration of the song in minutes (mm) and seconds (ss). A scroll thumb 1186 travels along the progress bar 1184 as the song plays or is being recorded. The user can click and drag the scroll thumb 1186 to scroll backwards or forward to any point in time in the song, if desired.

The Record 1125 button allows the user to create a new track or to modify an existing track of music. When the Record 1125 button is pressed, all notes previously recorded start to scroll across the main screen area at the tempo/speed selected by the user (see FIG. 12B, which allows the user to select the number of beats per minute and the number of beats per measure for the current song). The song/track/notes all start at time 0:00 unless the user moves the scroll thumb 1186 to a different point in time of the song. To assist in recording notes, each measure of the song is illustrated graphically on the screen. For example, each measure may have a different color or shading and may have a line therebetween so that it can be easily viewed by the user. When the Record 1125 button is pressed, the measures scroll graphically across/along the screen. The speed of the scrolling of the measures is based on the beats per minute and beats per measure tempo. In a preferred embodiment, a metronome or beat sound is played in the background when the user is recording a track. This allows the user to hear the tempo—in addition to seeing the tempo visually based on the speed of the moving measures. If there are any existing tracks (with notes) or if there are any notes already in the current track being created or edited, such notes move along with the measures and play when they reach the play bar 1176.

Figure 12A:
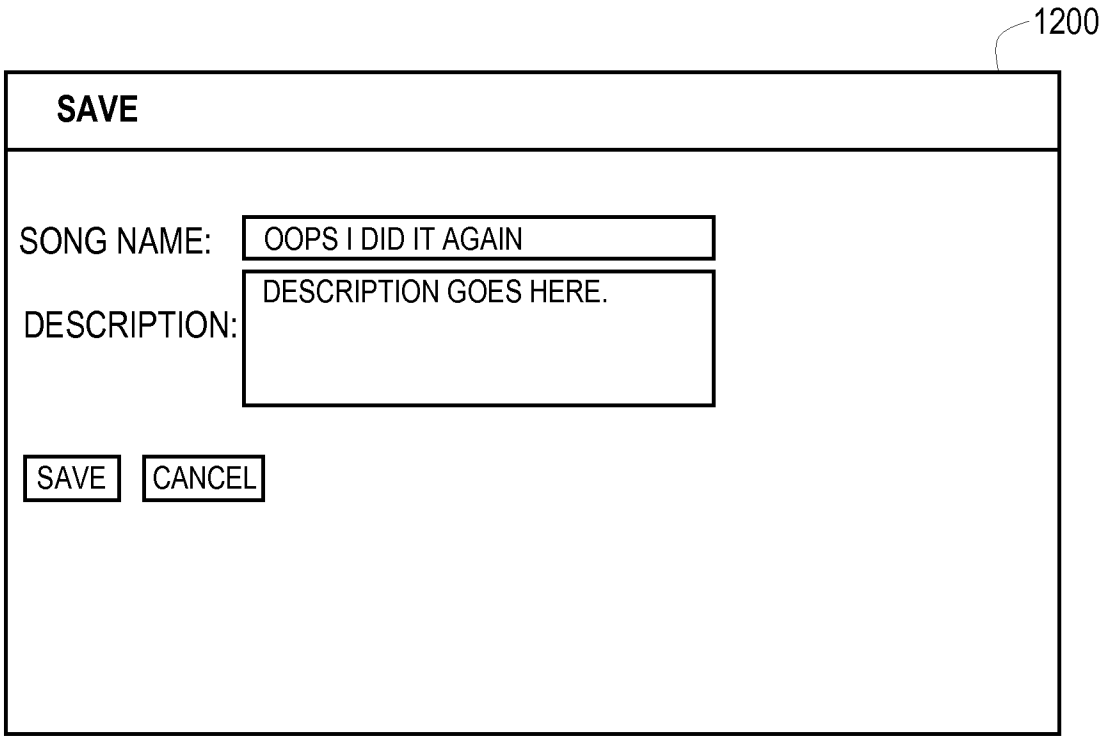
FIG. 12A illustrates a Custom Song Save screen used with the system of FIG. 1.
Figure 12B:
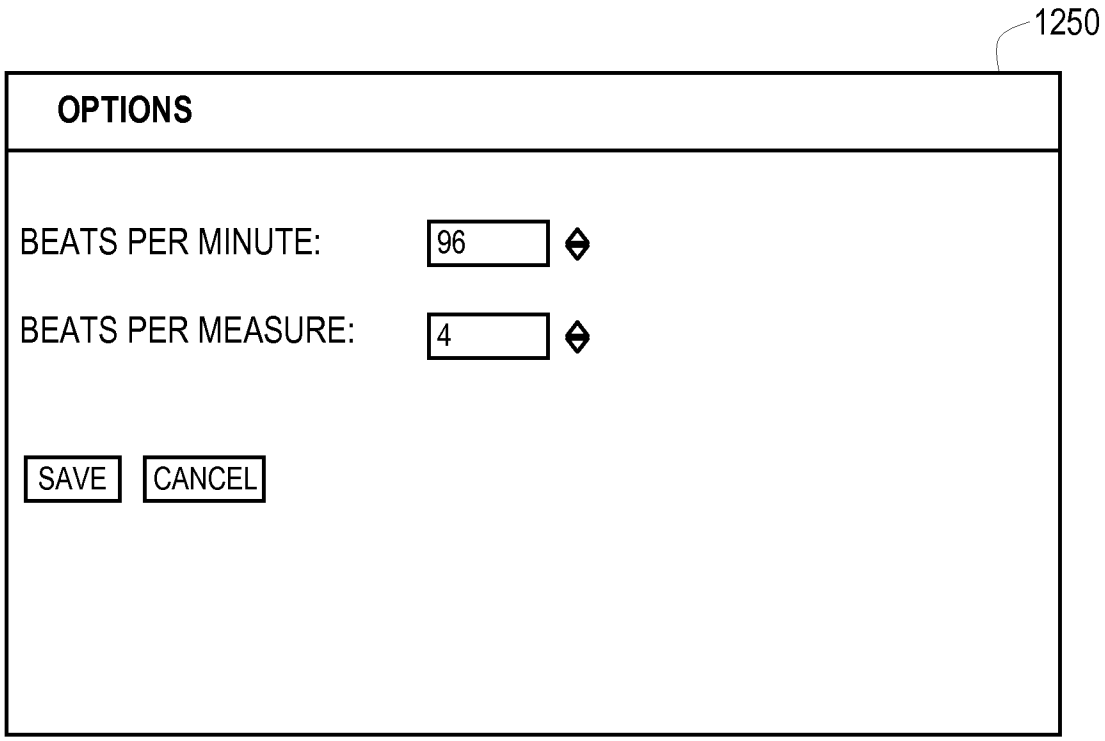
FIG. 12B illustrates a Custom Song Settings screen used with the system of FIG. 1.

To add or create new notes in the current track, the user merely types in notes, using the computer keyboard or virtual keyboard, which places the pressed note corresponding with the corresponding keyboard letter, on the main screen area at the play bar 1176. The length of the note is based on how long the user holds the key in pressed position. Major and Minor chords can be recorded by the user by holding the modifier key (as described above) and then (in sequence or simultaneously) pressing the appropriate keyboard key for the primary note of the chord. Notes are displayed, in real time, as the user types, on the play bar 1176. The tail of the note will extend, graphically, the longer the user holds the key of the note down on the keyboard. Additionally, as when in "Play" mode, the user will see all notes scroll across the play bar 1176 and then off the screen during "Record" mode. Notes will actually play to audio (through the speakers of the user's computing device) when the pre-existing notes hit the play bar 1176 and, for new notes being recorded, whenever the user presses and holds a key on the keyboard. Each pre-existing note will continue to play until the tail of the note finishes passing through the play bar 1176 and then they will fade rapidly. Newly recorded notes will appear in the play bar 1176 and the tail of the note will grow until the user releases the key. The sound associated with the new notes is based on the instrument currently selected in the instrument pull down menu 1194 (described in greater detail below). The Save button 1130 takes the user to a dialog screen 1200 with save options, as shown in FIG. 12A. The Options button 1140 presents the user with a dialog screen 1250 with settings for adjusting the Beats Per Minute and Beats Per Measure, as shown in FIG. 12B. The Delete button 1150, after a confirmation dialog box, deletes the current song (or track) off of the server.

As part of the recording and editing capabilities, the user is able to select a plurality of existing notes for action, such as those shown in selection box 1174. For example, the user can use "click and drag" or "tap and end point tap" techniques—depending upon the type of interface being used by the user with the user's computing device, such as a conventional computer web interface or a tablet/smart-phone screen, and the like to create selection box 1174, which contains one or more notes. Once a range of notes has been selected, the user can then drag the notes directly up or down on the screen to adjust the pitch up or down, as well as move them left or right to adjust their location on the timeline of the song/track. Additionally, once selected, the notes can be moved to the trash 1178, or cut or copied. Specifically, the Cut button 1155 cuts any selected notes, such as the notes in selection box 1174, from the current track. In conventional manner, the cut notes will be retained in a standard copy buffer for pasting later—unless and until copied over. The Copy button 1160 copies any selected notes, such as the notes in selection box 1174, from the current track. The notes are not cut or deleted from the current track, but they are retained, in conventional manner, in a copy buffer for pasting later. The Paste button 1165 pastes the contents, if possible, into the current track starting with the first note pasted directly on top of the play bar 1176. In the preferred embodiment, criteria for a successful paste require that there be no overlapping duplicate notes of the same pitch on the current track. If there are duplicated notes, an error screen will be presented. In a preferred embodiment, the user can adjust the duration of a note or a set of notes by clicking and dragging the tail of the note or one of the tails of the set of selected notes. In one embodiment, the user can also change a note by selecting an existing note and then either presses a new key, which changes the pitch of the note and changes the letter shown in the note and moves the note to the appropriate location on the screen. In another embodiment, the user can also change a note by clicking and dragging the note to the pitch and time location desired by the user. Once moved, the letter of the note changes accordingly.

In a preferred embodiment, all of the notes for the current track of the current song are displayed in the scrollable window 1172. In an alternative embodiment, notes for other tracks of the same song are displayed—either in a different color(s) and/or in a shadow or more translucent format—so that the time and scale relationship between notes in the track currently being worked on can be easily compared to other tracks already written for the same song. The Help button 1170 preferably opens a pop-up or side panel window to present the user with specific help instructions to creating new music. Basic user instructions for how to work within the music creation module to create and work with notes are preferably displayed continually in a window 1180 at the bottom of the screen.

The user can name the current track using the track name box 1190. The track pull down menu 1192, allows the user to toggle and quickly view and change to different tracks of the song that have already been written or are in the process of being written and have been previously saved. The pull down menu 1192 also includes an option for creating a new track, if the user has not previously saved the current track being worked on. The instrument pull down menu 1194, allows the user to associate an available instrument (and, hence, particular sound) used to play and generate the sound of the notes for the current track. Additionally, the Playable 1196 checkbox allows the user to select whether or not this home-made written track will be available to system users for playing this song in the game Play mode of the system.

Figure 13:
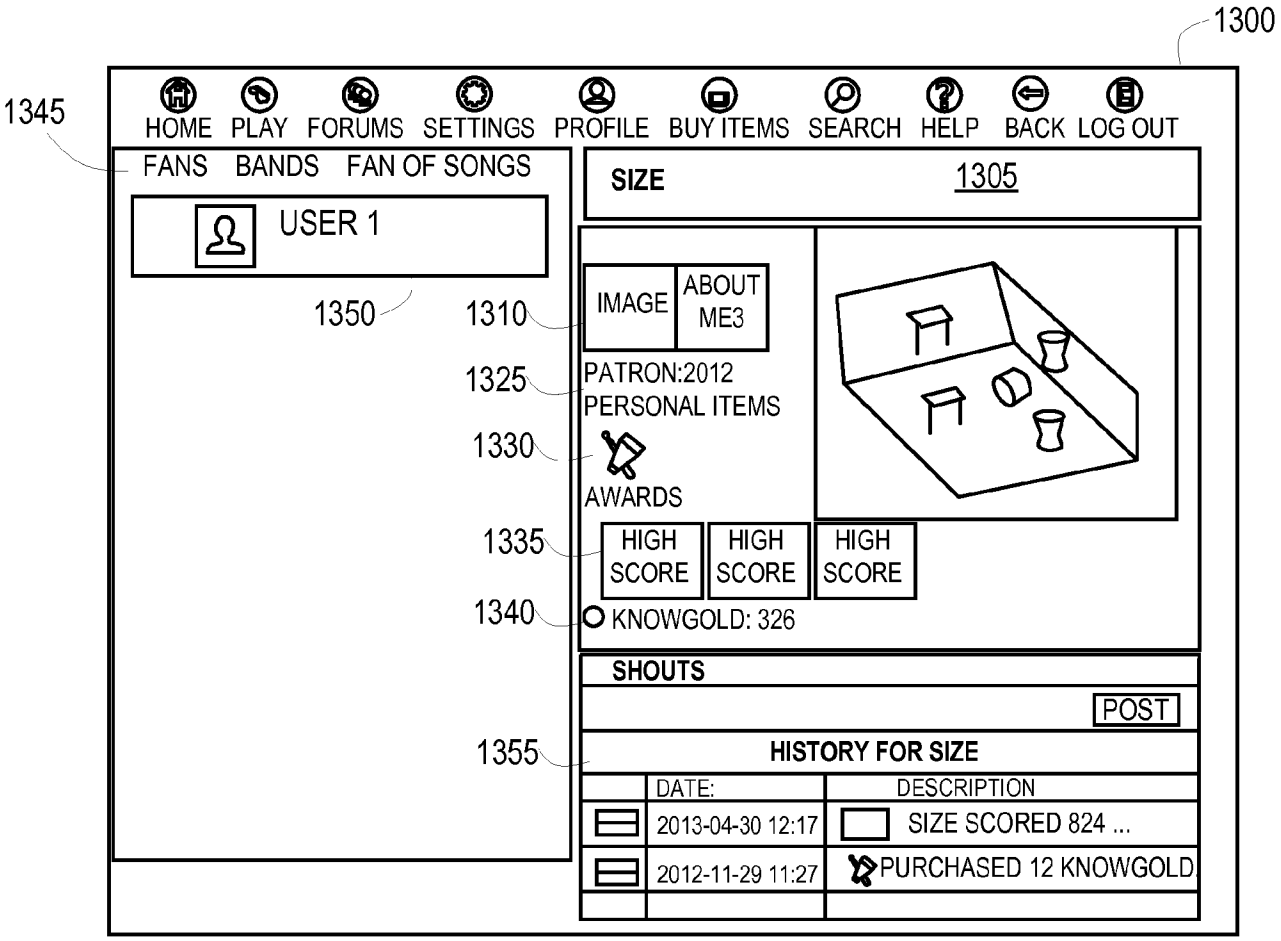
FIG. 13 illustrates a User Profile screen used with the system of FIG. 1.

The User Profile screen 1300 is shown in FIG. 13. This screen 1300 is accessed by selecting the Profile 355 button from FIG. 3, which takes a registered user to his own profile page. Alternatively, a user is able to search for and navigate to the Profile page of another user by selecting the Search 365 button from FIG. 3 and searching for a particular user name or by selecting/clicking on the name of another user from any other screen. The heading of the User Profile screen 1300 identifies the relevant user's name 1305 as well as an image 1310 uploaded by the user 110. The user 110 can also type in additional information or add hyperlinks within window 1315.

A virtual "room" 1320 is the user's personal space within which the user can place and store any virtual instruments and other items that the user may have purchased within the system, won as an award, obtained through a competition, obtained through a special event, or obtained as a gift from another user. The virtual room itself, in this case, has a garage theme, one of the default free room themes available to a user. Some room themes may be obtained or purchased, in the same manner as other items within the system, as explained above.

Items within the virtual room 1320 can be added from the user's personal store, shown in window 1320, removed to avoid a cluttered look, and arranged however the user feels appropriate. The customization of the user's virtual room gives the user something to be proud of, and anyone who visits their User Profile page 1300 will see their personal taste as well as hard work and accomplishments made within the system.

The Awards 1335 section of the User Profile page 1300 displays any special badges that the user has obtained. These can be, but are not limited to, obtaining an award for a high score, being the first person to play a song, completing a set of criteria, such as playing all the songs from a specific band, and the like. The "KnowGold" counter 1340 displays the current amount of virtual currency that the user has obtained, earned, bought, or acquired within the system and which can be used to purchase virtual instruments and other items within the system.

The fan-page window 1345 lists or otherwise identifies friends, fans, bands, and fans of songs that can be can be selected by the user. For example, a list of users, who are friends of the current user of the shown User Profile screen 1300 user, the band groups the user is a member of, and the songs the user has marked as songs that the user enjoys or likes may be itemized and listed at 1350. A history area 1355 displays all of the achievements that the user associated with this User Profile screen 1300 has obtained, plus can include a history of the user's chat sessions with other users, as well as any and all items or comments that the user has decided to share and post on various social networking sites.

Figure 14:
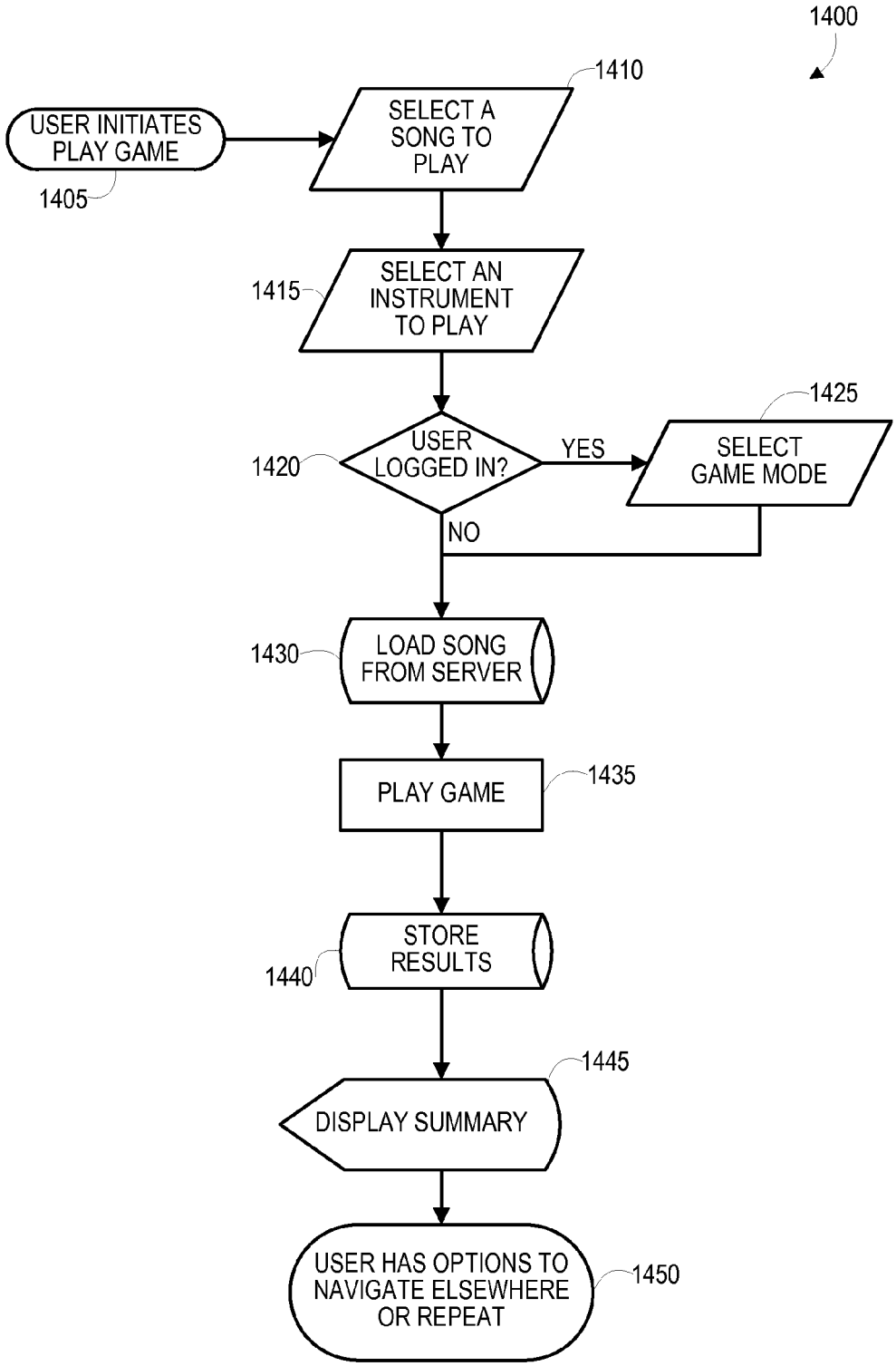
FIG. 14 illustrates a song selection process flow chart used with the system of FIG. 1.
Figure 15:
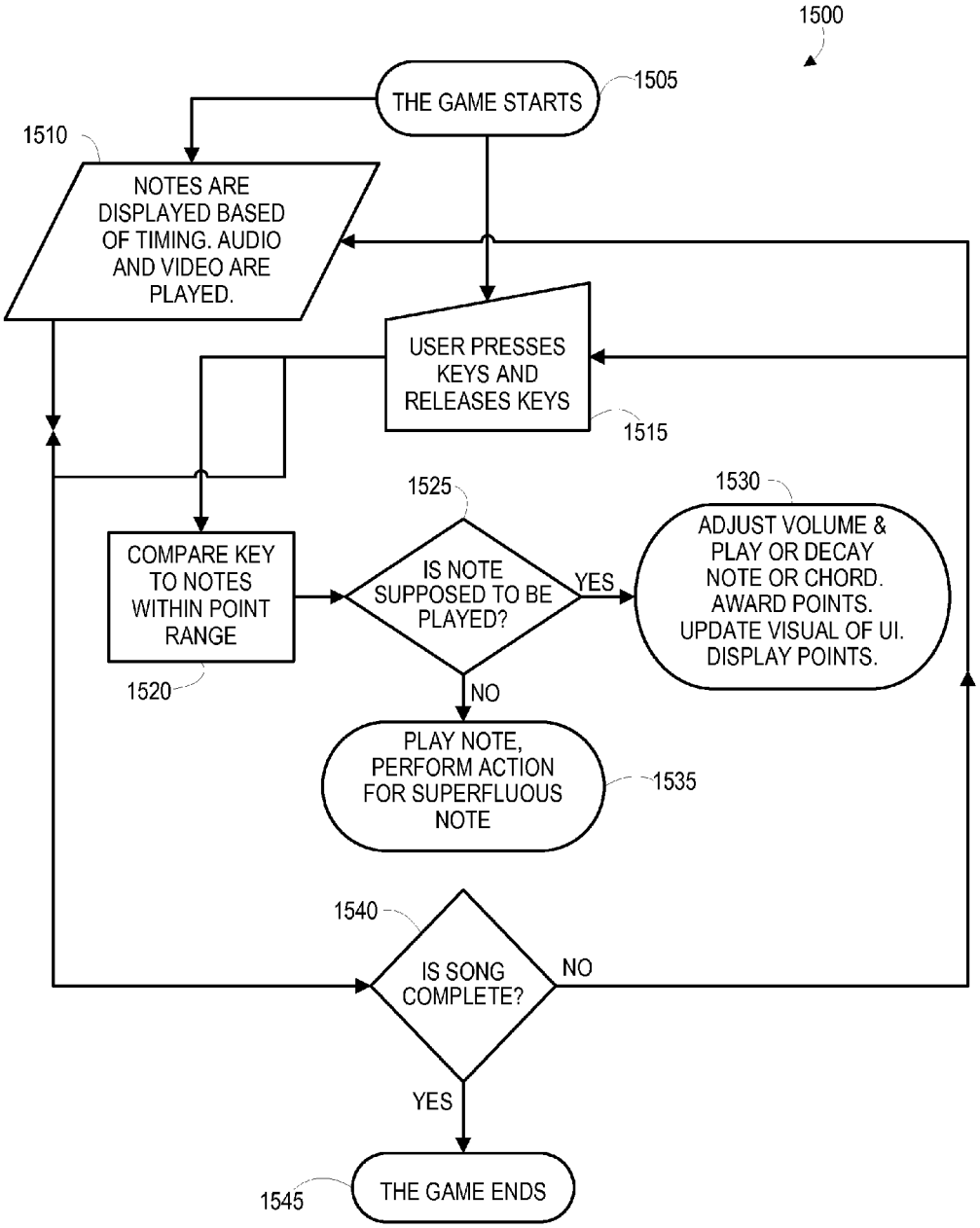
FIG. 15 illustrates a play game process flow chart used with the system of FIG. 1.

From a process standpoint, FIGS. 14 and 15 illustrate the primary process steps taken within the system for selecting and playing a song that is available to the user within the system. Specifically, the song selection process 1400 is illustrated in FIG. 14. After the user initiates or launches the game (step 1405), such as by pressing the Play Now! 305 button from FIG. 3, the user is taken to Song Selection screen 400, as shown in FIG. 4. On this screen, the user is able to select a song to play (step 1410). The user is then taken to Instrument Selection screen 500, as shown in FIG. 5, and selects the instrument and track (having a pre-defined difficulty level) that the user wants to play (step 1415). If the user is logged-in (as determined at step 1420), the user is allowed to select a game mode (i.e., whether the user wants to play with notes moving vertically or horizontally on the screen) (step 1425) and, preferably, is presented with a list of current high scores for the specific instrument selected for this particular song. If the user is not logged-in, but is only playing as an unregistered guest, the default game mode for the particular song will be used by the system. The song is then loaded from the system server 1430. The user then plays the game (step 1435), as described in more detail by the play process 1500 described hereinafter in association with FIG. 15. After the song/game has been completed, the results of the user's performance are stored on the server (step 1440). In addition, a summary of the user's performance is displayed on the user's screen (step 1445) for feedback and informational purposes. Preferably, the list of top scores for the instrument and song may also be displayed so that the user can see how he compares to the top users of the system. In addition, a list of virtual instruments that the user can purchase (or will soon be purchasable if the user continues to play and progress in proficiency with the system) is also displayed, as well as any awards that the user has already obtained—such as high score or first play. The user is then presented with options for continuing play or other use of the system, such as playing the same song, choosing a new song, going to the create music module, purchasing virtual items, sharing the performance on Facebook®, and the like (step 1450).

Once the song and track are selected by the user, the user is able to play the song in game mode. The process 1500 for playing the song in game mode is illustrated in FIG. 15. Specifically, the game is initiated (step 1505). Notes are displayed based off of timing information derived from the MIDI file associated with the song (step 1510). Audio is preferably played in digital quality or MIDI, using compressed or uncompressed methodologies. In some embodiments, video could be played as well. Checks are performed each time the user presses or depresses one of the keys or virtual keys on the keyboard associated with a note (step 1515). Whenever a key is depressed, the system determines which key has been depressed and compares the key that has been pressed to notes currently within an awardable points range (i.e., whether the correct key is pressed and held while the moving note symbol is within the play bar 675 or the larger band 680) (step 1520). If the note is supposed to be played, (as determined at step 1525), the system (at step 1530): adjusts the volume of the note being played, based off of MIDI details, plays the correct chord if the key note represents a chord, adjusts the graphics of the corresponding moving note symbol, and awards points based on whether the note is within the play bar 675 or the larger band 680, and then awards additional points if the note is held until the tail is also within the play bar 675 or the larger band 680. Additional bonus points may also be awarded based on difficulty level or based on number of notes played in a row correctly. If the note is not supposed to be played, (again, as determined at step 1525), then the system (at step 1535): plays the incorrect note as long as the user presses and hold the key, graphics showing that the note should not have been played (or was played too soon or too late) are displayed, and any points are deducted and any counters for notes played correctly in a row are reset, if desired, based on system settings. The system continuously checks to see if the song is finished playing, (as determined at step 1540). If so, then the song ends (step 1545). If not, the system continues to update (step 1510) the display, audio, and video, as well as check (step 1515) for further keyboard inputs.

Figure 16:
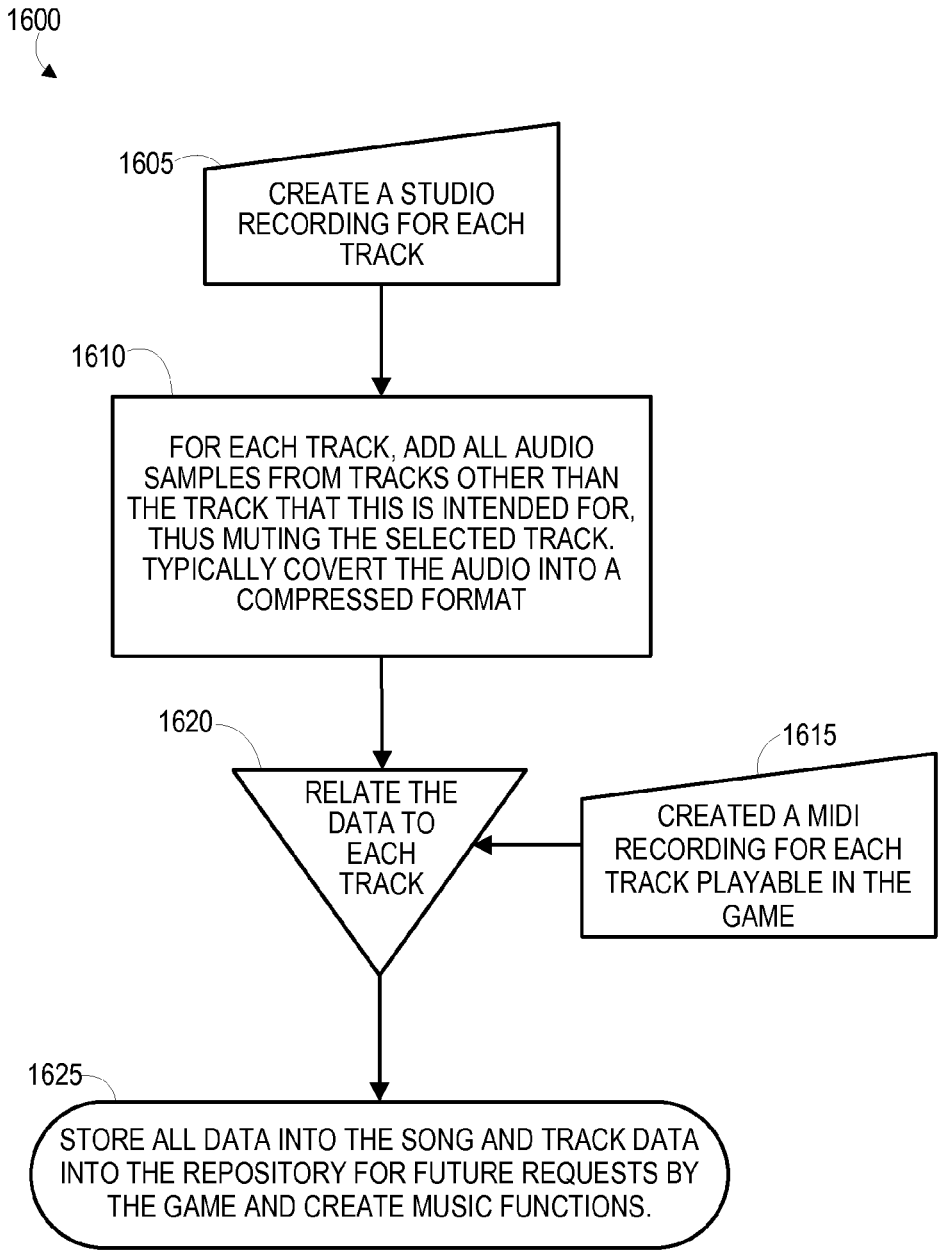
FIG. 16 illustrates a process flow chart for creating studio quality songs used with the system of FIG. 1.

Turning now to FIG. 16, a process 1600 for creating studio quality songs, with one or more tracks for playing by the user, is illustrated. This process 1600 is similar to the steps used by professional music studios for recording and mixing songs for a conventional music album. Preferably, a professional musician with skills playing one of the instruments available for playing within the system meets with a recording engineer. The engineer sets up multiple microphones around the professional musician in an acoustically-treated room. The musician then plays all notes chromatically, one at a time, very slowly across the range of the respective instrument. Once the instrument is captured, the files for all notes of that instrument are imported into audio editing software in which they are processed and individually exported to a desired file type according to program and system specifications, as will be appreciated by those of skill in the art.

Preferably, for each song that is to be recorded and added to the system so that a user can play one or more tracks associated with the song, such song is first analyzed to determine what instruments and vocalists are needed. Preferably, a group of musicians then meet in a recording studio to "cover" that song as close to the original as possible. Preferably, such recording is done in a standard multi-track session where most of the instruments and singers are recorded at the same time. Any additional instruments or vocal harmonies may be overdubbed, as desired.

All of the recorded songs are then mastered. The term "mastering," as it applies herein and with the present system, has a slightly different connotation than what it is generally known to be in the music industry. For the sake of clarity, as used herein, the term "mastering" is an umbrella term that is intended to include everything that happens between recording and exporting the song. This includes post-processing, which is applying effects like compression, equalization, delay, and reverb to each of the tracks. Mixing generally refers to adjusting and automating volumes of all the tracks. And finally mastering in the literal sense is global normalization of the song. All of the above is used to make the recorded song, and combination of tracks included with that song, sound as close to the original as possible.

The mastered song is then exported (step 1605). Typically, most songs that are recorded in a studio are exported as one stereo-interleaved file. However, in the present system, it is preferable that each track of the recorded song be exported individually, in what is called herein as a "stem." Each stem preferably includes its own post-processing and mix. The number of stems per song depends on the number of playable instruments that are available within the system for that song. The vocals and any extra instrumentation (such as a tambourine, shaker, or other non-sampled instruments that are part of the song, but not made available for play by users of the system) are preferably assembled together in a "base" stem that will always play along with the player-dependent tracks.

Preferably, all of the exported stems are transcribed into MIDI. An audio engineer listens to the song to determine the time-signature, tempo, and key. Then a MIDI track is created for each stem and notates what will be played by the audio software component if the system. The MIDI tracks are exported as one file that contains all the note information for all the instruments in the song.

MIDI tracks are created to parallel the live performance (step 1615). These tracks are then used to evaluate the user's performance and to determine a user's score. It is important that the engineer's mastering of a composition for the timing and pitch differences between the MIDI and the studio performance be as exact as possible. By the timing being exact, users playing the game will have a much more satisfying musical experience since they can play along with the live performance and feel like they are a member of the band.

The live version of each respective recording is then exported (step 1610) into an efficient compressed or other format applicable for client audio output format for the user's PC, PDA, SmartPhone application, Tablet application, or other user device to process and play through the client device. Data relevant to each individual tracks is associated therewith (step 1620). All of this data is then typically stored (step 1625) in a file system and in a database associated with the system server.

In one embodiment, the system can also simply allow a user to play the game with direct MIDI, as an end user recorded it, using a PC, PDA, SmartPhone, Tablet, or other user device with keyboard or virtual keyboard to create the master recording.

Another capability of the present system is for a user playing the game to use a combination of pre-recorded MIDI as well as utilizing a studio-recorded voice track, auxiliary tracks, or any combination of playing both MIDI and studio-recorded tracks. Any track that is recorded in a format other that MIDI, if desired to be playable in the game mode, would require that the user record a MIDI format, as well, such as by using the create music module described above.

In another embodiment, the system allows a user to use a studio to record both MIDI rendered tracks as well as importing any self-created or obtained external input, such as singing captured by a microphone, or real instrumentation, such as electric guitar, saxophone, or any analog of digital instrument, for that matter. By allowing the flexibility of using both MIDI and studio or other rendered input tracks, a performance becomes immersive, making for a better quality and end user experience while playing the game. Further, the system could include a video performance that could be merged in and played in full, or in parts, in a separate dedicated window or as part of the background of the play screen during the game performance.

Figure 17:
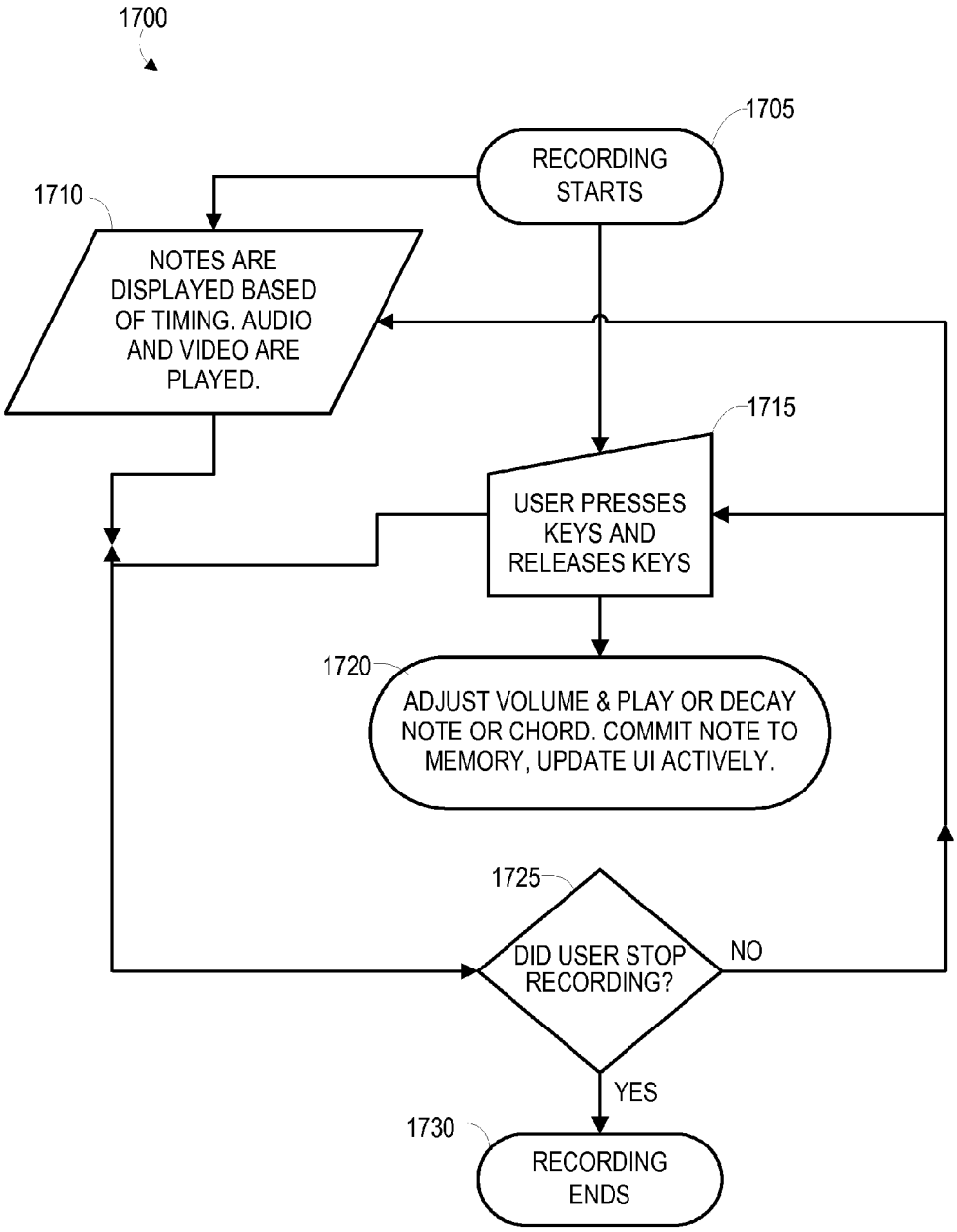
FIG. 17 illustrates a process flow chart for creating an original song used with the system of FIG. 1.

The process 1700 for enabling a user to create or write an original song is illustrated in FIG. 17. The user initiates a new song recording (step 1705), for example, by selecting the record button 1125, as shown in FIG. 11. Notes are displayed (step 1710) based off of timing information derived from the MIDI. Audio (corresponding with the displayed notes) is played in digital quality or MIDI, using compressed or uncompressed methodologies. In some embodiments, video could be played as well. Once a recording is started, the system continuously checks (step 1715) for user input in the form of pressing of a key or virtual key. Each time a key or virtual key is pressed, the system (at step 1720) sets the volume for the note to a predefined value for the particular track and song, the note play is initiated, the note start time within the song timeline is stored in system memory, and a note graphical symbol corresponding to the key pressed is generated. Once the key is released, the system then adjusts the duration of the note that will be replayed, note decay is set to the predefined decay rate, the note duration is stored in system memory, and the note graphical symbol is modified to reflect the duration of the note. As long as the user has not stopped the recording (as determined at step 1725), the system continues updating the user interface, audio, and video (step 1710) and the system continues to check (step 1715) for user input in the form of pressing of a key or virtual key. Once the user has stopped the recording (as determined at step 1725), then recording completes (step 1730).

Figure 18A:
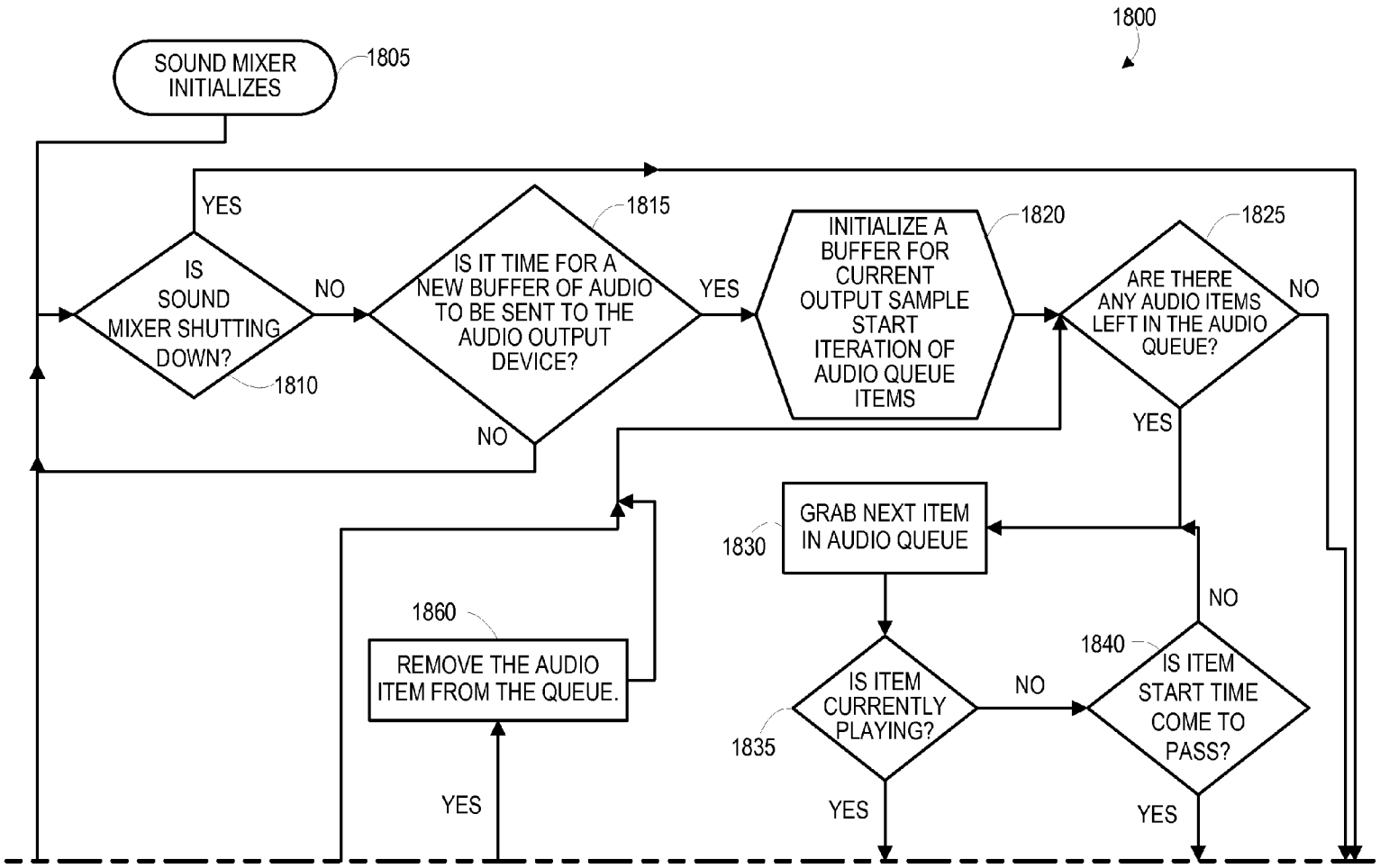
FIG. 18 illustrates a process flow chart for mixing sounds used with the system of FIG. 1.
Figure 18B:
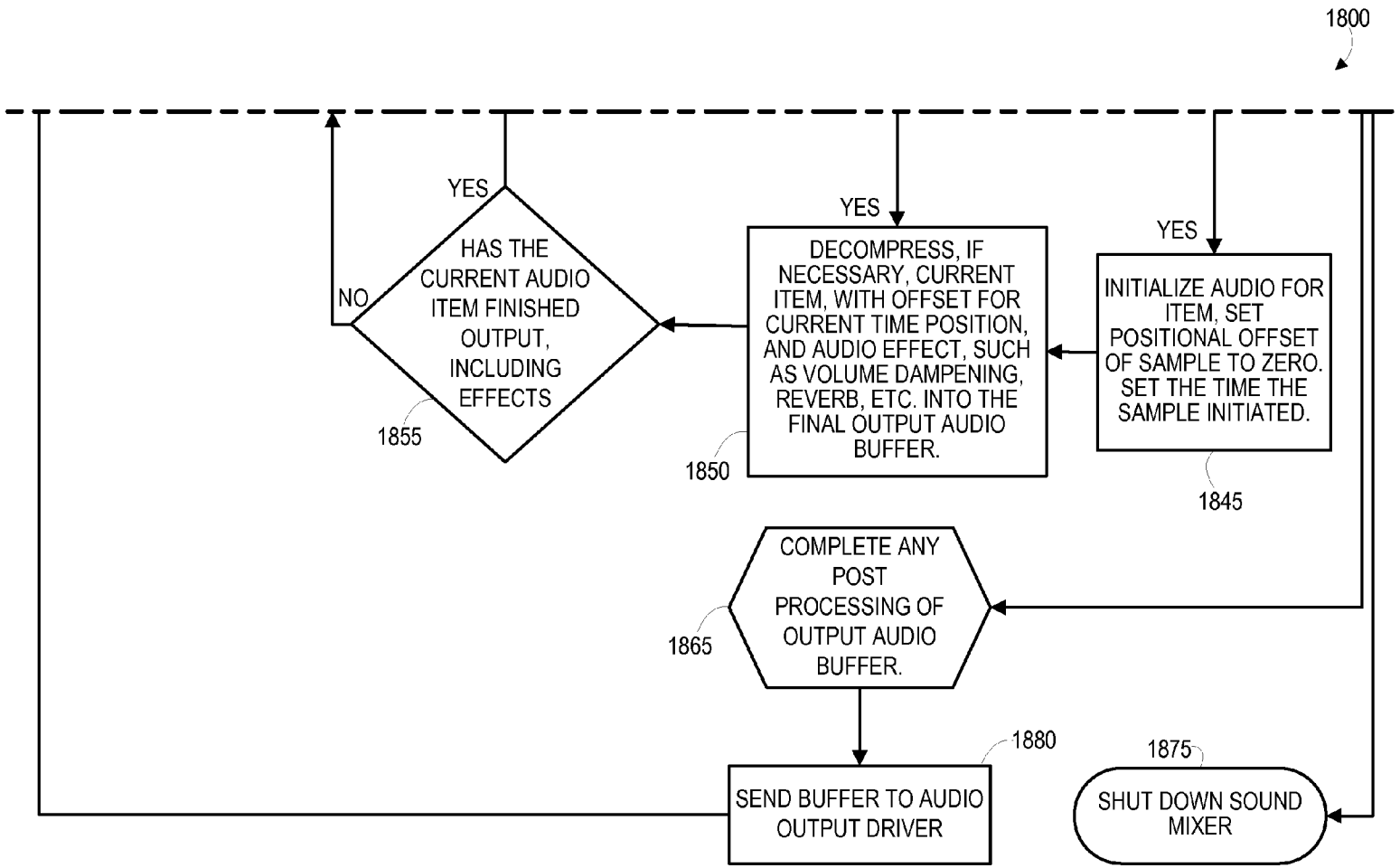
Figure 19:
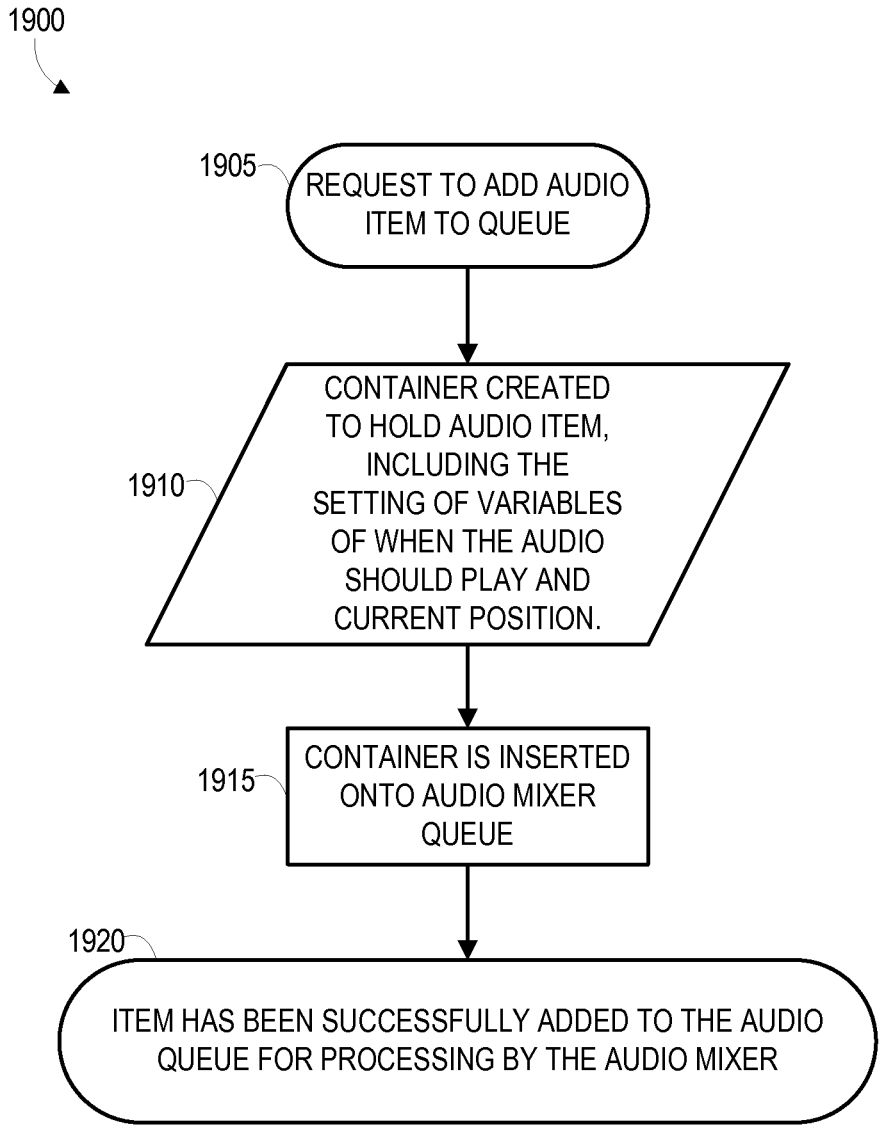
FIG. 19 illustrates a process flow chart for inserting new items into the sound mixer with the system of FIG. 1.

The processes for sound mixing used by the present system are illustrated in FIGS. 18 and 19. While there are many software technologies, languages used by the present system, such as TCP/IP, Web Services, JSON, Codecs, UDP, Java, Javascript, C++, and the like, there is one algorithm of particular complexity that needs to be mentioned in detail, and that is the sound mixing capability. The sound mixer is used to merge many samples of sound together, to merge sound from multiple sources, such as: a digital audio stream, compressed or decompressed, an instrument note that is initiated when a user presses a key, or when an instrument note, from another instrument from another audio track, is played by the MIDI processor. Without the use of this customized sound mixing capability described hereinafter, on most devices and software models, the built-in architecture simply is not fast enough to provide the robust mixing capabilities necessary by the present system. It is important to note that this technology should be built in such a way as to be very fast and efficient, so as not to take up much of the CPU cycles, especially on current hand-held user devices, such as SmartPhones and Tablet devices.

Turning now to FIG. 18, the process 1800 for mixing sounds (or multiple audio inputs) using an audio queue pipeline is illustrated. The audio queue contains a list of all audio currently scheduled to be played to the speakers on the computing device currently being used by a user of the system. First, initialization of the sound mixer (step 1805) takes place to create base objects, set up variables, and perform memory initialization of the sound mixer. Once the sound mixer has initialized, the main loop of the sound mixer starts. Typically, the main loop of the sound mixer is initiated based off of a scheduled call by the sound pipeline of the device being used by a user of the system. iOS is an example in which a call to the main loop of the sound mixer is made at specific intervals, as the sound system of iOS is in need of buffers to be filled. With other technologies in which there is only a single programming thread to perform all tasks on the device, such as Flash®, a call to the sound mixer may occur from the master thread, which calls other unrelated methods in a loop as well, to do processing. It is important to note that the primary loop pauses, in preferred embodiments, to give the central processor (CPU) of the device time to do other tasks and/or to increase battery life on devices that are not provided with electrical power from a plugged-in continuous source. In multi-threaded environments, many portions of the sound mixer may have to be aware of thread synchronization issues. An example where synchronization must be maintained is the audio queue pipeline itself, since one or more threads could be adding items into the audio queue pipeline. At the same time, the sound mixer is removing from the queue. Of course, synchronization is not necessary for single threaded environments.

The first step of the sound mixer loop is to determine whether the sound mixer is shutting down (as determined at step 1810). If not, then the system determines (at step 1815) whether it is time for a new buffer of audio to be sent to the audio output of the user's device. In some embodiments, like iOS, where the sound mixer is called by a call-back method, this check (at step 1815) is not necessary and is skipped, since the call-back is only called when it is time to send audio to the output device, and in that case, the system inherently recognizes that it is time for a new buffer of audio to be sent to the audio output of the user's device. If it is not time for a new buffer of audio to be sent to the audio output of the user's device (as determined at step 1815) or if the sound mixer is shutting down (as determined at step 1810), then the sound mixer performs any operations necessary to shut down the sound mixer, such as deallocation, memory resets, and general clean up (step 1875).

Initialization of the buffer, objects, variables, and memory occur for the current output sample (at step 1820). Additionally, an iterator is set to the beginning of the audio queue, such that the entire audio queue may be looped through on subsequent steps. At this point, deviation for specific implementations of this technology and algorithm does not occur until the buffer has been sent to the actual output device driver (at step 1870, described hereinafter).

After initialization of the buffer, objects, variables, and memory occur for the current output sample (at step 1820), a determination is then made (at step 1825) to see if there are any items left to iterate through in the audio queue. In the special case in which the audio queue is completely empty, the determination made at step 1825 is assumed to be negative (no) and the system proceeds to step 1865 for post processing of the output (described hereinafter). Under the normal flow, the determination made at step 1825 is negative (no) after the last item in the audio queue is processed and the system proceeds to step 1865 for post processing of the output (described hereinafter).

When all items in the audio queue have been processed, any post processing of output occurs (at step 1865) and then the buffer is sent to the audio output driver (step 1870). Depending on the software and hardware of the user's device, the object and implementation of methods vary for the specifics of sending the buffer to the output device driver. Once the buffer is sent to the output driver, the process 1800 returns back to step 1810 to check again whether the sound mixer is shutting down.

If there are more audio items left in the audio queue, as determined at step 1825, then the system grabs the next item in the audio queue for processing (step 1830). A check is then performed to determine if the audio sample is currently playing (determination at step 1835). If the answer at step 1835 is negative (no), then a further check is performed (determination at step 1840) to see if the start time has come to pass. If the sample is not supposed to start playing yet, the determination at step 1840 is negative (no) and the process returns back to step 1830.

If the determination at step 1840 is affirmative (yes), then the audio item is: initialized, the positional offset for the sample is set to zero, and the time-signature is initialized to the current time, so that the exact point of time that the sample is started is understood by further portions of the process (step 1845).

If there is an affirmative (yes) determination at step 1835, and after completion of step 1845, the audio sample is decompressed, if necessary, the current item is then processed, adding in any audio effects, such as volume adjustment, reverberation, dampening, stereo effects, etc., the end product of processing of the current audio item is then added into the final audio buffer, and offsets are then updated to the sample just processed so that the audio sample will know what to play next time step 1820 is performed (step 1850).

A check is then performed (at step 1855) to see if the current audio item has finished output, meaning the sample is through playing. If the answer at step 1855 is affirmative (yes), then the audio item is removed from the queue and any clean-up necessary for removal is performed (step 1860) and then the process 1800 continues back to step 1825, for the next item to be processed in the audio queue. If the answer at step 1855 is negative (no), then the process 1800 continues directly back to step 1825, for the next item to be processed in the audio queue.

When the sound mixer is informed to shut down (at step 1810), the process 1800 continues to step 1875, where any necessary operations, such as deallocation, memory resets, and general clean up, occur.

The process 1900 of inserting new items into the sound mixer queue is illustrated in FIG. 19. Initially, a method call is made (step 1905) to request to add an item to the audio mixer queue. Next, a container that is either a structure or an object is created (step 1910) to hold the audio item, and initialization occurs, which could include the setting of variables, initializing memory, and constructing buffers. Settings are established to indicate when the audio should start playing and the current position that audio should start. The container is then inserted into the audio mixer queue (step 1915). The system then returns (step 1920) to the thread or function that made the original method call (at step 1905) and the audio container is then further processed according to the process 1800, as described with respect to FIG. 18.

In view of the foregoing detailed description of preferred embodiments of the present invention, it readily will be understood by those persons skilled in the art that the present invention is susceptible to broad utility and application. While various aspects have been described in the context of screen shots, additional aspects, features, and methodologies of the present invention will be readily discernable therefrom. Many embodiments and adaptations of the present invention other than those herein described, as well as many variations, modifications, and equivalent arrangements and methodologies, will be apparent from or reasonably suggested by the present invention and the foregoing description thereof, without departing from the substance or scope of the present invention. Furthermore, any sequence(s) and/or temporal order of steps of various processes described and claimed herein are those considered to be the best mode contemplated for carrying out the present invention. It should also be understood that, although steps of various processes may be shown and described as being in a preferred sequence or temporal order, the steps of any such processes are not limited to being carried out in any particular sequence or order, absent a specific indication of such to achieve a particular intended result. In most cases, the steps of such processes may be carried out in various different sequences and orders, while still falling within the scope of the present inventions. In addition, some steps may be carried out simultaneously. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

We claim:

1. A computerized system for enabling a user to compose a song, comprising:

at least one processor, a memory storage, a video display, a user input, a keyboard, an audio output, wherein the video display, the keyboard, the user input, and the audio output are each in electronic communication with the at least one processor, and a non-transitory computer-readable medium that is usable by the at least one processor and is operatively coupled to the memory storage, the computer-readable medium having stored thereon a sequence of instructions that when executed by the at least one processor causes the execution of the steps of:

displaying a compose song screen to the user on the video display, the compose song screen having a progress bar displaying a timeline ranging between a start time and an end time of the song, the progress bar including a thumb that is scrollable along the timeline and that, based on its relative position along the timeline, identifies the current time position of the song between the start time and the end time, the compose song screen further having a play bar associated with the current time position of the song;

through use of the user input and the keyboard, enabling the user to interact with the video display in order to name a first track of the song and to select an instrument to be associated with said first track;

assigning notes of the selected instrument to respective keys on the keyboard;

through use of the user input and the keyboard, enabling the user to interact with the video display in order to select a tempo for the song, the tempo identifying a number of beats per minute and a number of beats per measure for the song, wherein each measure of the song is illustrated graphically on the compose song screen and positioned relative to the play bar; and upon initiating recording of the first track: (i) causing each graphically-illustrated measure of the song to scroll sequentially toward and across the play bar at a speed determined by the tempo of the song; (ii) receiving notes from the user based on one or more keys pressed by the user on the keyboard, each of said notes being associated with the current time position of the song based on when the key associated with each respective note is pressed and having a duration based on how long the key associated with each respective note is held in the pressed position; and (iii) wherein, in response to each key pressed by the user:

(A) a graphical representation of the note assigned to each respective key is generated and initially displayed within the measure currently scrolling across the play bar on the compose song screen and wherein the length of the graphical representation of the respective note corresponds to the duration of the respective note; and (B) an audio representation of the note assigned to each respective key is generated and played by the audio output for the duration, the sound of the note corresponding to the selected instrument.

2. The computerized system of claim 1, wherein the user interacts with the video display using the user input to initiate and stop the recording of the first track.

3. The computerized system of claim 2, wherein the stopping of the recording defines the end time of the song.

4. The computerized system of claim 2, wherein the stopping of the recording defines a time prior to the end time of the song.

5. The computerized system of claim 2, wherein after stopping of the recording, the sequence of instructions further causes the execution of the step of saving the recording of the first track.

6. The computerized system of claim 2, wherein after stopping of the recording, the sequence of instructions further causes the execution of the step of replaying the recording of the first track.

7. The computerized system of claim 1, wherein, during recording of the first track, the sequence of instructions further causes the execution of the step of generating a beat that is played through the audio output and that corresponds to the tempo of the song.

8. The computerized system of claim 1, wherein the user is able to change the current time position of the song by moving the scrollable thumb using the user input to a desired position along the timeline.

9. The computerized system of claim 1, wherein the graphical representation of the note assigned to each respective key includes a graphic symbol that corresponds with the respective key.

10. The computerized system of claim 1, wherein the play bar is linear, has a predefined width, and is fixedly displayed near an edge of the compose song screen.

11. The computerized system of claim 1, wherein the graphical representation of the note is fixedly displayed within the measure currently scrolling across the compose song screen such that the graphical representation of the note moves perpendicularly across the play bar.

12. The computerized system of claim 1, wherein graphical representations of notes of one or more additional tracks of the song are displayed on the compose song screen during recording of the first track.

13. The computerized system of claim 12, wherein each of the one or more additional tracks of the song is associated with a different, respective instrument other than the selected instrument.

14. The computerized system of claim 1, wherein audio representations of notes of the one or more additional tracks of the song are generated and played by the audio output during recording or replaying of the first track.

15. The computerized system of claim 14, wherein each of the one or more additional tracks of the song is associated with a different, respective instrument other than the selected instrument and wherein the sound of the notes are synthesized to replicate notes generated by each of said different, respective instruments corresponding with each of the one or more additional tracks of the song.

16. An electronic music system, comprising:

at least one processor, a memory storage, a video display, a user input enabling a user to interact with the video display, an audio output, wherein the video display, the user input, and the audio output are each in electronic communication with the processor, and a non-transitory computer-readable medium that is usable by the at least one processor and is operatively coupled to the memory storage, the computer-readable medium having stored thereon a sequence of instructions that when executed by the at least one processor causes the execution of the steps of:

generating one or more objects, each object associated with a respective musical note of a song, each object having a front and a tail defining therebetween a respective length, the respective length of the object indicative of the duration of the musical note associated with the object;

displaying the one or more objects on the video display, the one or more objects each having a graphic symbol included therein, each graphic symbol corresponding with a respective key on the user input, the respective key being associated with the musical note associated with the respective object, the one or more objects being initially displayed near one edge of the video display;

displaying a linear play bar on the video display, the play bar having a predefined width and being fixedly displayed near an opposite edge of the video display from the one or more objects;

upon initiation of playback of the song, moving the one or more objects from the one edge of the video display perpendicularly toward the play bar, wherein when the front of each respective object reaches the play bar indicates when the musical note associated with the respective object should be played and when the tail end of the respective object leaves the play bar indicates when the musical note associated with the respective object should cease being played;

receiving input from the user in the form of one or more keys of the user input being pressed and then released by the user as the one or more objects move perpendicularly toward and across the play bar;

in response to the input received from the user, generating sounds that are played through the audio output, each of the sounds corresponding with the musical note associated with the respective key pressed by the user and continuing until the respective key is released by the user; and providing feedback to the user based on when each key is pressed and released by the user as compared to when each corresponding object crosses over the play bar.

17. The electronic music system of claim 16 wherein the video display, the user input, and the audio output are all components of a user device.

18. The electronic music system of claim 17 wherein the user device includes one of the following: a cell phone, a smart phone, a PDA, a desktop computer, a laptop computer, a multimedia device, or a computer tablet.

19. The electronic music system of claim 16 wherein the user input includes a virtual or physical keyboard.

20. The electronic music system of claim 19 wherein a row of keys on the keyboard represents a range of musical notes and wherein the pitch of each of the range of notes increases with each key moving in a linear direction along the row.

21. The electronic music system of claim 19 wherein a first row of keys on the keyboard represents a first octave of musical notes and a second row of keys on the keyboard represents a second octave of musical notes.

22. The electronic music system of claim 19 wherein a row of keys on the keyboard represent a range of musical notes and wherein pressing one of the shift keys on the keyboard changes the octave of the range of musical notes.

23. The electronic music system of claim 19 wherein each of a plurality of keys on the keyboard is associated with a unique musical note and wherein pressing a chord modifier key on the keyboard reassigns each of the respective plurality of keys to a chord associated with each corresponding musical note.

24. The electronic music system of claim 16 wherein the user input includes a virtual or physical point and click device.

25. The electronic music system of claim 16 wherein the user input includes a touch screen of the video display.

26. The electronic music system of claim 16 wherein all of the respective musical notes are associated with one of a plurality of tracks associated with a song.

27. The electronic music system of claim 26 wherein each one of the plurality of tracks is associated with a respective one or more instruments and wherein the sound that is played through the audio output is synthesized to replicate musical notes generated by said respective one or more instruments, wherein the pitch and duration of each musical note corresponds to the respective key pressed and then released by the user.

28. The electronic music system of claim 26 wherein each one of the plurality of tracks has an associated difficulty level.

29. The electronic music system of claim 26 wherein the user is responsible for playing the musical notes of one of the plurality of tracks of the song and wherein all of the musical notes and vocals of the remaining tracks of the song are synchronized with the user's track and played simultaneously through the audio output.

30. The electronic music system of claim 26 wherein the user is responsible for playing the musical notes of one of the plurality of tracks of the song and wherein one or more additional users are each responsible for playing the musical notes of another respective one of the plurality of tracks of the song, wherein all of the plurality of tracks are synchronized and wherein all of the musical notes and vocals of any remaining tracks of the song not being played by the user or by the one or more additional users are played simultaneously through the audio output.

31. The electronic music system of claim 30 wherein each of the one or more additional users has a respective video display, user input, and audio output and wherein each of the one or more additional users only sees the moving objects on their respective video display corresponding to the musical notes associated with their respective track of the song.

32. The electronic music system of claim 16 wherein the step of providing feedback to the user includes awarding points to the user if the user presses and holds the key corresponding with each respective object as said object crosses the play bar.

33. The electronic music system of claim 32 wherein higher points are awarded to the user the closer the front of each respective object is to the play bar when the user presses the corresponding key and the closer the tail of each respective object is to leaving the play bar when the user releases said corresponding key.

34. The electronic music system of claim 32 wherein the points awarded to the user are displayed on the video display.

35. The electronic music system of claim 16 wherein the step of providing feedback to the user includes modifying the appearance of each respective object as a function of how accurately the user presses and holds the key corresponding with the respective object as said object crosses the play bar.

* * * * *